US012435401B2

(12) United States Patent
Kondo et al.

(10) Patent No.: US 12,435,401 B2
(45) Date of Patent: Oct. 7, 2025

(54) STEEL MATERIAL

(71) Applicant: NIPPON STEEL CORPORATION, Tokyo (JP)

(72) Inventors: Keiichi Kondo, Tokyo (JP); Yuji Arai, Tokyo (JP); Keiichi Nakamura, Tokyo (JP); Taro Oe, Tokyo (JP); Takenori Kuramoto, Tokyo (JP); Yosuke Takeda, Tokyo (JP); Hiroki Kamitani, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 478 days.

(21) Appl. No.: 17/995,368

(22) PCT Filed: Apr. 15, 2021

(86) PCT No.: PCT/JP2021/015628
§ 371 (c)(1),
(2) Date: Oct. 3, 2022

(87) PCT Pub. No.: WO2021/210655
PCT Pub. Date: Oct. 21, 2021

(65) Prior Publication Data

US 2023/0203631 A1 Jun. 29, 2023

(30) Foreign Application Priority Data

Apr. 15, 2020 (JP) ..... 2020-073017

(51) Int. Cl.
*C22C 38/54* (2006.01)
*C21D 9/08* (2006.01)
(Continued)

(52) U.S. Cl.
CPC ..... *C22C 38/54* (2013.01); *C21D 9/08* (2013.01); *C22C 38/001* (2013.01);
(Continued)

(58) Field of Classification Search
None
See application file for complete search history.

(56) References Cited

U.S. PATENT DOCUMENTS

2011/0247733 A1 10/2011 Arai et al.
2016/0060723 A1* 3/2016 Yamazaki ..... C22C 38/06 148/330

FOREIGN PATENT DOCUMENTS

CN 102224268 A 10/2011
JP 2017002369 A 1/2017
JP 2018168425 A 11/2018

* cited by examiner

*Primary Examiner* — Brian D Walck
(74) *Attorney, Agent, or Firm* — Greer, Burns & Crain, Ltd.

(57) ABSTRACT

The steel material according to the present disclosure consists of, in mass %, C: 0.15 to 0.45%, Si: 0.05 to 1.00%, Mn: 0.05 to less than 0.80%, P: 0.030% or less, S: 0.0100% or less, Al: 0.100% or less, Cr: 0.30 to 1.50%, Mo: 0.25 to 2.00%, Ti: 0.001 to 0.015%, N: 0.0100% or less, O: 0.0050% or less, V: 0 to 0.05%, Nb: 0 to 0.010%, B: 0 to less than 0.0005%, Ca: 0 to 0.0100%, Mg: 0 to 0.0100%, and rare earth metal: 0 to 0.0100%, with the balance being Fe and impurities. In the steel material, the grain size number of prior-austenite grains is less than 7.0, Formula (1) to Formula (4) described in the specification are satisfied, the yield strength is 896 MPa or more, and the absorbed energy at −10° C. is 95 J or more.

8 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/001* (2013.01)

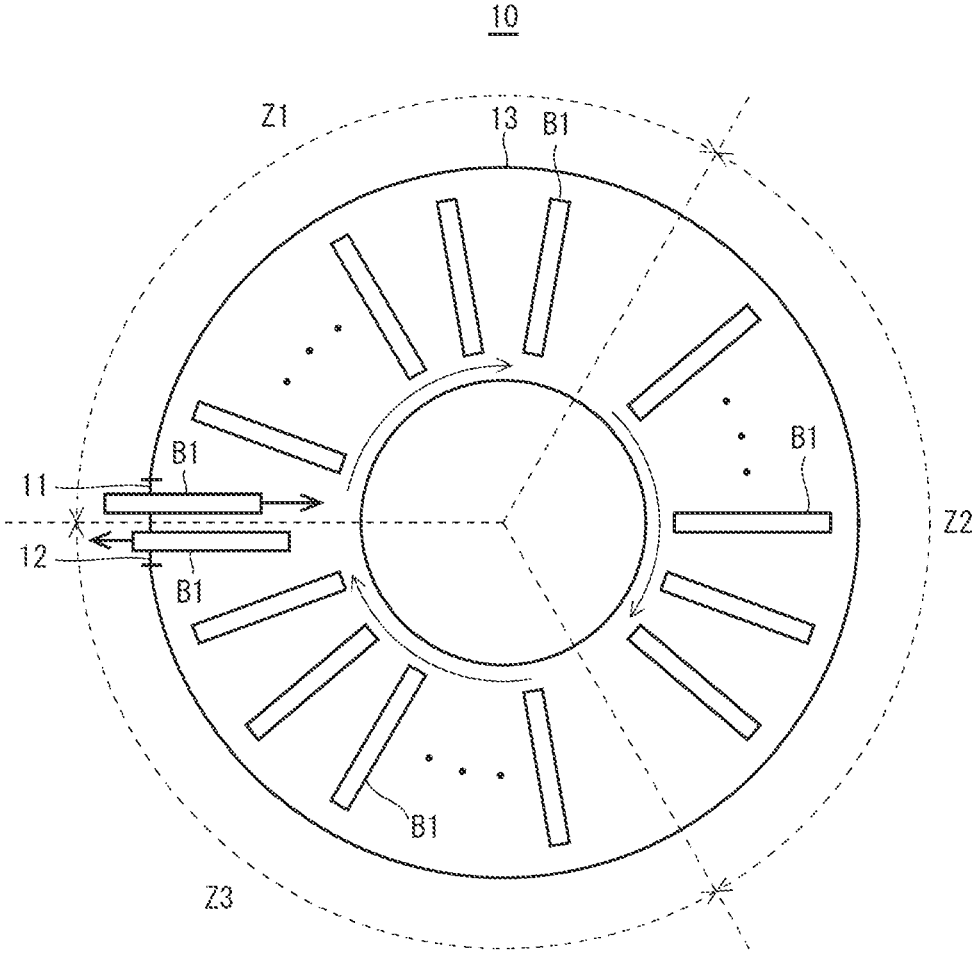
10
Z1
13
B1
B1
11
12
B1
B1
Z2
B1
Z3

STEEL MATERIAL

TECHNICAL FIELD

The present disclosure relates to a steel material, and more particularly relates to a steel material for use in oil wells.

BACKGROUND ART

Oil wells and gas wells (hereinafter, oil wells and gas wells are collectively referred to simply as "oil wells") are being made increasingly deeper, and consequently there is a demand to increase the strength of steel materials for use in oil wells, which are typified by oil-well steel pipes. Currently, oil-well steel pipes having a yield strength of 80 ksi grade (yield strength is 80 to less than 95 ksi, that is, 552 to less than 655 MPa) and oil-well steel pipes having a yield strength of 95 ksi grade (yield strength is 95 to less than 110 ksi, that is, 655 to less than 758 MPa) are widely utilized as steel materials for use in oil wells. However, recently demands have also started to be made for steel material having a yield strength of 110 ksi grade (yield strength is 110 to less than 125 ksi, that is, 758 to less than 862 MPa), and steel material having a yield strength of 125 ksi (862 MPa) or more.

In addition, recently oil wells are also being developed in cold regions. Oil-well steel pipes to be used in a deep well in such cold regions are required to have not only high strength, but also excellent low-temperature toughness.

Patent Literature 1 (Japanese Patent Application Publication No. 2017-2369) proposes a seamless steel pipe that has a yield strength of 125 ksi or more and excellent low-temperature toughness. The seamless steel pipe disclosed in Patent Literature 1 contains, in mass %, C: 0.21 to 0.35%, Si: 0.10 to 0.50%, Mn: 0.05 to 1.00%, P: 0.025% or less, S: 0.010% or less, Al: 0.005 to 0.100%, N: 0.010% or less, Cr: 0.10 to 1.30%, Mo: 0.05 to 1.00%, Ti: 0.002 to 0.040%, V: 0 to 0.30%, Nb: 0 to 0.050%, and B: 0 to 0.0050%, and also contains one or two types of element selected from the group consisting of Ca: 0.0010 to 0.0060% and rare earth metal: 0.0010 to 0.0060%, with the balance being Fe and impurities. The grain size number of prior-austenite grains of this seamless steel pipe is 7.0 or more. In addition, among sulfide-based inclusions in this seamless steel pipe, the number of specific sulfide-based inclusions having a major axis of 1 μm or more is 5000/100 $m^2$ or less, and an average aspect ratio of the specific sulfide-based inclusions is 3.4 or less. In addition, the yield strength of this seamless steel pipe is 862 MPa or more.

In the seamless steel pipe disclosed in Patent Literature 1, low-temperature toughness is increased by making the grain size number of prior-austenite grains 7.0 or more, and refining the grains. Specifically, in the production process, the heating temperature of the starting material before hot working is set to 1100° C. or less, and the rotational speed of a skew roll during piercing-rolling is slowed to suppress the occurrence of processing-incurred heat during piercing-rolling. By this means, the grains are kept fine. In the seamless steel pipe of Patent Literature 1, furthermore, the strength and low-temperature toughness of the seamless steel pipe are enhanced by grain refining and precipitation strengthening by precipitates such as Ti precipitates, V precipitates, or Nb precipitates.

CITATION LIST

Patent Literature

Patent Literature 1: Japanese Patent Application Publication No. 2017-2369

SUMMARY OF INVENTION

Technical Problem

However, a steel material having a high strength and excellent low-temperature toughness may also be obtained by a technique other than the technique described in Patent Literature 1.

An objective of the present disclosure is to provide a steel material that has a high yield strength and also has excellent low-temperature toughness.

Solution to Problem

The steel material according to the present disclosure consists of, in mass %,

C: 0.15 to 0.45%,
Si: 0.05 to 1.00%,
Mn: 0.05 to less than 0.80%,
P: 0.030% or less,
S: 0.0100% or less,
Al: 0.100% or less,
Cr: 0.30 to 1.50%,
Mo: 0.25 to 2.00%,
Ti: 0.001 to 0.015%,
N: 0.0100% or less,
O: 0.0050% or less,
V: 0 to 0.05%,
Nb: 0 to 0.010%,
B: 0 to less than 0.0005%.
Ca: 0 to 0.0100%,
Mg: 0 to 0.0100%,
rare earth metal: 0 to 0.0100%,
Ni: 0 to 0.50%, and
Cu: 0 to 0.50%,
with the balance being Fe and impurities,
wherein:
a grain size number of prior-austenite grains is less than 7.0:
on a precondition that a content of each element is within a range described above, Formula (1) to Formula (4) are satisfied;
a yield strength is 896 MPa or more; and
an absorbed energy at −10° C. is 95 J or more:

$$\{C+Mn/5+(Cu+Ni)/15+(Cr+Mo+V)/5+10\times B\}\times(7.0/GN)^{0.45}\geq 0.678 \quad (1)$$

$$\{Mn/5.5+10\times Ti+1.2\times V+15\times Nb+200\times B\}\times(7.0/GN)^{0.45}\leq 0.240 \quad (2)$$

$$10\times Ti+V+10\times Nb\geq 0.015 \quad (3)$$

$$(10\times Ti+1.2\times V+30\times Nb)/Mo\leq 0.205 \quad (4)$$

where, a content in mass % of a corresponding element is substituted for each symbol of an element, and the grain size number is substituted for "GN".

Advantageous Effects of Invention

The steel material according to the present disclosure has a high yield strength and also has excellent low-temperature toughness.

BRIEF DESCRIPTION OF DRAWING

FIG. 1 is a schematic diagram (plan view) illustrating a rotary hearth heating furnace that is one example of a continuous heating furnace.

DESCRIPTION OF EMBODIMENTS

The present inventors conducted studies with respect to a steel material which has excellent low-temperature toughness while also increasing the strength of the steel material. In the conventional steel materials for use in oil wells, as is also described in Patent Literature 1, to obtain a high strength of 862 MPa or more (125 ksi or more), the strength of the steel material is increased by precipitation strengthening by precipitates such as Ti precipitates, V precipitates, or Nb precipitates. Therefore, initially the present inventors investigated means for increasing the low-temperature toughness of a steel material while also increasing the strength of the steel material by precipitation strengthening.

Inclusions are a cause of a decrease in the low-temperature toughness of a steel material. Mn. Ti, and B are elements that form inclusions. On the other hand, as mentioned above, V precipitates and Nb precipitates increase the strength of a steel material by precipitation strengthening. Therefore, the present inventors considered increasing the strength of a steel material by suppressing the formation of inclusions by lowering the contents of Mn, Ti and B and, in addition, by precipitation strengthening by V and Nb.

However, as a result of further investigation, the present inventors found that it is difficult to compatibly achieve both high strength and excellent low-temperature toughness just by simply lowering the contents of elements that form inclusions. Specifically, although high strength was obtained, excellent low-temperature toughness was not sufficiently obtained. Therefore, the present inventors conducted further studies regarding the reason why low-temperature toughness cannot be sufficiently obtained. As a result, it has been revealed that the cause of a decrease in low-temperature toughness in a cold environment of less than 0° C. is not only inclusions, and also includes precipitates. Therefore, the present inventors considered that in a case where, as in the conventional steel material, a precipitation strengthening mechanism that strengthens by means of precipitates is adopted as the main strengthening mechanism for increasing the strength of a steel material, a limit exists with regard to sufficiently increasing the low-temperature toughness in a cold environment of less than 0° C.

Therefore, in order to compatibly achieve both high strength and excellent low-temperature toughness, the present inventors thought of adopting a strengthening mechanism which strengthens by improving the hardenability as the main strengthening mechanism of a steel material instead of the strengthening mechanism that strengthens by precipitation strengthening that is adopted in the conventional steel materials. In this case, from the viewpoint of the chemical composition, it is preferable that the contents of elements that are liable to form inclusions and precipitates can be kept low while also containing elements that increase hardenability.

Therefore, the present inventors conducted studies with regard to a chemical composition that is suitable for the aforementioned technical idea. As a result, the present inventors considered that if a steel material has a chemical composition consisting of, in mass %, C: 0.15 to 0.45%, Si: 0.05 to 1.00%, Mn: 0.05 to less than 0.80%, P: 0.030% or less, S: 0.0100% or less, Al: 0.100% or less. Cr: 0.30 to 1.50%, Mo: 0.25 to 2.00%, Ti: 0.001 to 0.015%, N: 0.0100% or less, O: 0.0050% or less, V: 0 to 0.05%, Nb: 0 to 0.010%, B: 0 to less than 0.0005%, Ca: 0 to 0.0100%, Mg: 0 to 0.0100%, rare earth metal (REM): 0 to 0.0100%, Ni: 0 to 0.50%, and Cu: 0 to 0.50%, with the balance being Fe and impurities, there is a possibility that both high strength and excellent low-temperature toughness can be compatibly achieved.

As mentioned above, in the steel material of the present embodiment, a strengthening mechanism that strengthens by improving the hardenability is adopted as the main strengthening mechanism of the steel material. In this connection, the coarser the grains of the steel material are, the more the hardenability will increase. Therefore, rather than making the grains fine grains as in the conventional steel materials, the present inventors conceived of making the grains in the steel material of the present embodiment coarse grains to thereby increase the strength of the steel material. As the result of studies conducted by the present inventors, the present inventors considered that when the contents of the respective elements in the chemical composition are within the ranges described above, if the grain size number of the prior-austenite grains of the steel material is less than 7.0 there is a possibility that the hardenability of the steel material can be further increased and the strength can be increased.

Therefore, taking the above described requirements as a precondition, in order to compatibly achieve both high strength and excellent low-temperature toughness in a steel material having the chemical composition described above, the present inventors conducted more detailed studies regarding (1) the relation between hardenability improving elements in the chemical composition described above and the grain size, (2) the relation between elements that form inclusions and precipitates and the grain size, (3) the auxiliary use of a precipitation strengthening mechanism, and (4) the auxiliary use of a solid-solution strengthening mechanism by means of Mo. As a result, the present inventors discovered that, on the precondition that the contents of the respective elements in the chemical composition are within the ranges described above, if Formula (1) to Formula (4) are also satisfied, it is possible to sufficiently achieve both high strength and excellent low-temperature toughness:

$$\{C+Mn/5+(Cu+Ni)/15+(Cr+Mo+V)/5+10\times B\}\times(7.0/GN)^{0.45}\geq 0.678 \quad (1)$$

$$\{Mn/5.5+10\times Ti+1.2\times V+15\times Nb+200\times B\}\times(7.0/GN)^{0.45}\leq 0.240 \quad (2)$$

$$10\times Ti+V+10\times Nb\geq 0.015 \quad (3)$$

$$(10\times Ti+1.2\times V+30\times Nb)/Mo\leq 0.205 \quad (4)$$

where, the content in mass % of a corresponding element is substituted for each symbol of an element, and the grain size number of prior-austenite grains is substituted for "GN". Hereunder, Formula (1) to Formula (4) are described.

Regarding Formula (1), F1 is defined as $F1=\{C+Mn/5+(Cu+Ni)/15+(Cr+Mo+V)/5+10\times B\}\times(7.0/GN)^{0.45}$. F1 is an index of the hardenability of the steel material. As mentioned above, elements that improve hardenability (hereinafter, also referred to as "hardenability improving elements"), and the size of the prior-austenite grains synergistically affect the hardenability. Each of C, Mn, Cu, Ni, Cr, Mo, V and B in F1 is a hardenability improving element. In addition, the term $(7.0/GN)^{0.45}$ in F1 indicates the degree to which the prior-austenite grain size contributes to the hardenability.

If F1 is less than 0.678, even if the content of each element in the chemical composition is within the range of the present embodiment and Formula (2) to Formula (4) are satisfied, the hardenability of the steel material will be insufficient. In this case, the yield strength of the steel material cannot be sufficiently increased. If the content of each element in the chemical composition of the steel material is within the range of the present embodiment and F1 is 0.678 or more, on the precondition that the chemical composition satisfies Formula (2) to Formula (4) that are described later, the strength of the steel material can be sufficiently increased. Specifically, the yield strength of the steel material can be made 896 MPa (130 ksi) or more.

Regarding Formula (2), F2 is defined as $F2=\{Mn/5.5+10\times Ti+1.2\times V+15\times Nb+200\times B\}\times(7.0/GN)^{0.45}$. F2 is an index of the low-temperature toughness of the steel material. As mentioned above, when the content of each element in the chemical composition is within the range of the present embodiment, each of Mn, Ti, V, Nb and B is likely to form inclusions or precipitates. Hereunder, these elements are also referred to as "inclusion/precipitate forming elements". In a case where these elements have formed inclusions and/or precipitates, if the prior-austenite grains are coarse, cracks are liable to occur. On the other hand, if the prior-austenite grains are fine grains, the propagation of cracks is easily suppressed. Accordingly, the inclusion/precipitate forming elements and the grain size number of the prior-austenite grains synergistically affect the low-temperature toughness. Each of Mn, Ti, V, Nb and B in F2 is an inclusion/precipitate forming element. In addition, the term $(7.0/GN)^{0.45}$ in F2 indicates the degree to which the prior-austenite grain size contributes to the low-temperature toughness.

If F2 is more than 0.240, even if the contents of the respective elements in the chemical composition are within the ranges described above, and the chemical composition satisfies Formula (1), Formula (3) and Formula (4), inclusions and/or precipitates that contain Mn, Ti, V, Nb and B will excessively form in the steel material. Therefore, in a case where the yield strength of a steel material in which the content of each element in the chemical composition is within the range of the present embodiment is made 896 MPa (130 ksi) or more, the low-temperature toughness of the steel material will decrease. Specifically, the absorbed energy at −10° C. will be less than 95 J. If F2 is 0.240 or less, the formation of inclusions and/or precipitates containing Mn, Ti, V. Nb and B in the steel material can be sufficiently suppressed. Therefore, on the precondition that the contents of the respective elements in the chemical composition are within the ranges described above and the chemical composition satisfies Formula (1), Formula (3) and Formula (4), excellent low-temperature toughness is also obtained while sufficiently increasing the strength of the steel material.

Regarding Formula (3), F3 is defined as $F3=10\times Ti+V+10\times Nb$. F3 is an index of a precipitation strengthening mechanism that is utilized in an auxiliary manner as a strengthening mechanism in a steel material in which the content of each element in the chemical composition is within the range of the present embodiment. In the steel material of the present embodiment, in principle a strengthening mechanism which strengthens by improving the hardenability by satisfying Formula (1) is adopted as the main strengthening mechanism. However, in a steel material in which the contents of the respective elements in the chemical composition are within the ranges described above, in some cases a yield strength of 896 MPa (130 ksi) or more cannot be stably obtained by only a hardenability strengthening mechanism. Therefore, in the present embodiment, in addition to a hardenability strengthening mechanism, a precipitation strengthening mechanism which strengthens by precipitation of Ti, V and Nb is employed in an auxiliary manner. If F3 is 0.015 or more, the precipitation strengthening mechanism can be utilized in an auxiliary manner in addition to the hardenability strengthening mechanism. Thus, on the precondition that the content of each element in the chemical composition is within the range of the present embodiment, and the chemical composition satisfies Formula (1), Formula (2) and Formula (4), the strength of the steel material can be sufficiently increased. Specifically, the yield strength of the steel material becomes 896 MPa (130 ksi) or more.

Regarding Formula (4), F4 is defined as $F4=(10\times Ti+1.2\times V+30\times Nb)/Mo$. F4 is an index of the degree to which Mo contributes to improving the low-temperature toughness. As mentioned above, the strength of the steel material of the present embodiment is increased by adopting a strengthening mechanism that strengthens by improving the hardenability as the main strengthening mechanism of the steel material. In addition, the low-temperature toughness of the steel material is increased by reducing inclusions and precipitates as much as possible. However, in some cases a sufficiently high yield strength of 896 MPa (130 ksi) or more cannot be stably obtained only by increasing the strength of the steel material by means of only the strengthening mechanism that strengthens by improving the hardenability. Therefore, as defined in Formula (3), in addition to the strengthening mechanism that strengthens by improving the hardenability, a precipitation strengthening mechanism that strengthens by precipitation of Ti, V and Nb is adopted in an auxiliary manner. However, when precipitates of Ti, V and Nb increase, the low-temperature toughness of a steel material in which the contents of the respective elements in the chemical composition are within the ranges described above decreases.

Here, Mo not only increases the strength of a steel material by improving the hardenability, but also strengthens the steel material by solid-solution strengthening. Solid-solution strengthening by Mo can suppress a decrease in the low-temperature toughness caused by Ti, V and Nb precipitates. Therefore, in the present embodiment, the ratio of the Mo content with respect to the content of Ti, V and Nb is increased. If F4 is 0.205 or less, the ratio of the Mo content with respect to the content of Ti, V and Nb will be high. In this case, even when precipitation strengthening mechanism is utilized in an auxiliary manner, a decrease in the low-temperature toughness can be suppressed. Therefore, on the precondition that the content of each element in the chemical composition is within the range of the present embodiment, and Formula (1) to Formula (3) are also satisfied, the strength of the steel material can be sufficiently increased and excellent low-temperature toughness can also be obtained.

As described above, in the steel material of the present embodiment, in order to increase not just the strength but also the low-temperature toughness, a strengthening mechanism that strengthens by improving the hardenability is adopted instead of a precipitation strengthening mechanism that the conventional steel materials actively adopt as the main strengthening mechanism. In addition, in order to cause the strengthening mechanism that strengthens by improving the hardenability to act more strongly, prior-austenite grains are intentionally made coarse grains. Furthermore, in order to achieve both high strength and excellent low-temperature toughness, hardenability improving elements, inclusion/precipitate forming elements, and the prior-austenite grain size are adjusted so as to satisfy Formula (1) to Formula (4). By having the above described configuration, in the steel material of the present embodiment, while making the yield strength 896 MPa or more, the absorbed energy at −10° C. can also be made 95 J or more.

The steel material of the present embodiment has been completed based on the technical idea described above, and is as follows.

[1]

A steel material consisting of, in mass %,

C: 0.15 to 0.45%,

Si: 0.05 to 1.00%,

Mn: 0.05 to less than 0.80%,

P: 0.030% or less,

S: 0.0100% or less,

Al: 0.100% or less,

Cr: 0.30 to 1.50%,

Mo: 0.25 to 2.00%,

Ti: 0.001 to 0.015%,

N: 0.0100% or less,

O: 0.0050% or less,

V: 0 to 0.05%,

Nb: 0 to 0.010%.

B: 0 to less than 0.0005%,

Ca: 0 to 0.0100%,

Mg: 0 to 0.0100%, rare earth metal: 0 to 0.0100%,

Ni: 0 to 0.50%, and

Cu: 0 to 0.50%, with the balance being Fe and impurities, wherein:

a grain size number of prior-austenite grains is less than 7.0;

on a precondition that a content of each element is within a range described above. Formula (1) to Formula (4) are satisfied;

a yield strength is 896 MPa or more; and an absorbed energy at −10° C. is 95 J or more:

$$\{C+Mn/5+(Cu+Ni)/15+(Cr+Mo+V)/5+10\times B\}\times(7.0/GN)^{0.45}\geq 0.678 \quad (1)$$

$$\{Mn/5.5+10\times Ti+1.2\times V+15\times Nb+200\times B\}\times(7.0/GN)^{0.45}\leq 0.240 \quad (2)$$

$$10\times Ti+V+10\times Nb\geq 0.015 \quad (3)$$

$$(10\times Ti+1.2\times V+30\times Nb)/Mo\leq 0.205 \quad (4)$$

where, a content in mass % of a corresponding element is substituted for each symbol of an element, and the grain size number is substituted for "GN".

[2]

The steel material according to [1], wherein:

a number density of Mn sulfides having an equivalent circular diameter of 5.0 μm or more is 10/100 $m^m$ or less; and an absorbed energy at −10° C. is 100 J or more.

[3]

The steel material according to [1] or [2], containing one or more types of element selected from the group consisting of:

V: 0.01 to 0.05%,

Nb: 0.001 to 0.010%,

B: 0.0001 to less than 0.0005%,

Ca: 0.0001 to 0.0100%,

Mg: 0.0001 to 0.0100%, rare earth metal: 0.0001 to 0.0100%,

Ni: 0.01 to 0.50%, and

Cu: 0.01 to 0.50%.

[4]

The steel material according to any one of [1] to [3], wherein:

the steel material is an oil-well steel pipe.

The steel material according to the present embodiment will be described in detail below. The sign "%" following each element means mass % unless otherwise noted.

[Chemical Composition]

The chemical composition of the steel material according to the present embodiment contains the following elements.

C: 0.15 to 0.45%

Carbon (C) improves hardenability, thus increasing the strength of the steel material. If the C content is less than 0.15%, the aforementioned effect cannot be sufficiently obtained even if the contents of other elements are within the range of the present embodiment. On the other hand, if the C content is more than 0.45%, even if the contents of other elements are within the range of the present embodiment, the strength of the steel material will be too high and, as a result, the low-temperature toughness of the steel material will decrease. Therefore, the C content is 0.15 to 0.45%. A lower limit of the C content is preferably 0.17%, more preferably 0.20%, further preferably 0.22%, and further preferably 0.24%. An upper limit of the C content is preferably 0.40%, more preferably 0.36%, further preferably 0.34%, further preferably 0.32%, and further preferably 0.30%.

Si: 0.05 to 1.00%

Silicon (Si) deoxidizes steel. If the Si content is less than 0.05%, the aforementioned effect cannot be sufficiently obtained even if the contents of other elements are within the range of the present embodiment. On the other hand, if the Si content is more than 1.00%, even if the contents of other elements are within the range of the present embodiment, the low-temperature toughness of the steel material will decrease. Therefore, the Si content is 0.05 to 1.00%. A lower limit of the Si content is preferably 0.10%, more preferably 0.13%, further preferably 0.15%, further preferably 0.17%, and further preferably 0.20%. An upper limit of the Si content is preferably 0.85%, more preferably 0.70%, further preferably 0.60%, further preferably 0.50%, and further preferably 0.40%.

Mn: 0.05 to Less than 0.80%

Manganese (Mn) deoxidizes steel. Mn also improves hardenability of the steel material, thus increasing the strength of the steel material. If the Mn content is less than 0.05%, the aforementioned effects cannot be sufficiently obtained even if the contents of other elements are within the range of the present embodiment. On the other hand, if the Mn content is 0.80% or more, Mn segregates at grain boundaries together with impurities such as P and S. Furthermore, an excessively large amount of coarse Mn sulfides will form. In this case, the low-temperature toughness of the steel material will decrease even if the contents of other elements are within the range of the present embodiment. Therefore, the Mn content is 0.05 to less than 0.80%. A lower limit of the Mn content is preferably 0.15%, more preferably 0.25%, further preferably 0.30%, further preferably 0.35%, and further preferably 0.40%. An upper limit of the Mn content is preferably 0.79%, more preferably 0.78%, further preferably 0.75%, further preferably 0.70%, and further preferably 0.65%.

P: 0.030% or Less

Phosphorus (P) is an impurity which is unavoidably contained. That is, the P content is more than 0%. If the P content is more than 0.030%, even if the contents of other elements are within the range of the present embodiment, P will segregate at grain boundaries and the low-temperature toughness of the steel material will decrease. Therefore, the P content is 0.030% or less. An upper limit of the P content is preferably 0.025%, more preferably 0.020%, and further preferably 0.015%. The P content is preferably as low as possible. However, excessively reducing the P content will result in a significant increase in the production cost. Therefore, considering industrial production, a lower limit of the P content is preferably 0.001%, and more preferably 0.003%.

S: 0.0100% or Less

Sulfur (S) is an impurity which is unavoidably contained. That is, the S content is more than 0%. If the S content is more than 0.0100%, even if the contents of other elements are within the range of the present embodiment. S will segregate at grain boundaries and the low-temperature toughness of the steel material will decrease. Therefore, the S content is 0.0100% or less. An upper limit of the S content is preferably 0.0080%, more preferably 0.0070%, further preferably 0.0060%, further preferably 0.0050%, and further preferably 0.0045%. The S content is preferably as low as possible. However, excessively reducing the S content will result in a significant increase in the production cost. Therefore, considering industrial production, a lower limit of the S content is preferably 0.0001%, and more preferably 0.0003%.

Al: 0.100% or Less

Aluminum (Al) is unavoidably contained. That is, the Al content is more than 0%. Al deoxidizes steel. When Al is contained even in a small amount, the aforementioned effect will be obtained to some extent. However, if the Al content is more than 0.100%, coarse oxide-based inclusions will form even if the contents of other elements are within the range of the present embodiment. In this case, the low-temperature toughness of the steel material will decrease. Therefore, the Al content is 0.100% or less. A lower limit of the Al content is preferably 0.001%, more preferably 0.005%, further preferably 0.010%, and further preferably 0.020%. An upper limit of the Al content is preferably 0.080%, more preferably 0.070%, further preferably 0.060%, and further preferably 0.050%. Note that the "Al" content referred to in the present description means the content of "acid-soluble Al," that is, "sol. Al".

Cr: 0.30 to 1.50%

Chromium (Cr) improves hardenability of the steel material. Cr also increases temper softening resistance. Thus, Cr increases the strength of the steel material. If the Cr content is less than 0.30%, the aforementioned effects cannot be sufficiently obtained even if the contents of other elements are within the range of the present embodiment. On the other hand, if the Cr content is more than 1.50%, the low-temperature toughness of the steel material will decrease even if the contents of other elements are within the range of the present embodiment. Therefore, the Cr content is 0.30 to 1.50%. A lower limit of the Cr content is preferably 0.40%, more preferably 0.45%, further preferably 0.50%, and further preferably 0.60%. An upper limit of the Cr content is preferably 1.40%, more preferably 1.30%, and further preferably 1.20%.

Mo: 0.25 to 2.00%

Molybdenum (Mo) increases hardenability of the steel material. In addition, Mo dissolves in the steel material and thereby strengthens the steel material. If the steel material is strengthened by dissolved Mo, a decrease in the low-temperature toughness attributable to V precipitates, Nb precipitates and Ti precipitates can be suppressed. Hence, Mo can increase the strength of the steel material while suppressing the occurrence of a decrease in the low-temperature toughness. If the Mo content is less than 0.25%, the aforementioned effect cannot be sufficiently obtained even if the contents of other elements are within the range of the present embodiment. On the other hand, if the Mo content is more than 2.00%, even if the contents of other elements are within the range of the present embodiment, the low-temperature toughness of the steel material will, on the contrary, decrease. Therefore, the Mo content is 0.25 to 2.00%. A lower limit of the Mo content is preferably 0.28%, more preferably 0.30%, and further preferably 0.35%. An upper limit of the Mo content is preferably 1.50%, more preferably 1.25%, further preferably 1.00%, and further preferably 0.80%.

Ti: 0.001 to 0.015%

Titanium (Ti) forms precipitates (nitrides) and increases the strength of the steel material by precipitation strengthening. If the Ti content is less than 0.001%, the aforementioned effect cannot be sufficiently obtained. On the other hand, if the Ti content is more than 0.015%, even if the contents of other elements are within the range of the present embodiment, coarse inclusions will form, and an excessively large amount of Ti precipitates will form. In this case, the low-temperature toughness of the steel material will markedly decrease. Accordingly, the Ti content is 0.001 to 0.015%. A lower limit of the Ti content is preferably 0.002%, more preferably 0.003%, further preferably 0.004%, and further preferably 0.005%. An upper limit of the Ti content is preferably 0.012%, more preferably 0.010%, further preferably 0.009%, and further preferably 0.008%.

N: 0.0100% or Less

Nitrogen (N) is an impurity which is unavoidably contained. That is, the N content is more than 0%. If the N content is more than 0.0100%, N will form coarse nitrides even if the contents of other elements are within the range of the present embodiment. In this case, the low-temperature toughness of the steel material will decrease. Therefore, the N content is 0.0100% or less. An upper limit of the N content is preferably 0.0080%, more preferably 0.0070%, further preferably 0.0060%, and further preferably 0.0055%. The N content is preferably as low as possible. However, excessively reducing the N content will result in a significant increase in the production cost. Therefore, considering industrial production, a lower limit of the N content is preferably 0.0001%, and more preferably 0.0010%.

O: 0.0050% or Less

Oxygen (O) is an impurity which is unavoidably contained. That is, the O content is more than 0%. If the O content is more than 0.0050%, even if the contents of other elements are within the range of the present embodiment, O will form coarse oxides and the low-temperature toughness of the steel material will decrease. Accordingly, the O content is 0.0050% or less. An upper limit of the O content is preferably 0.0040%, more preferably 0.0030%, and further preferably 0.0025%. The O content is preferably as low as possible. However, excessively reducing the O content will result in a significant increase in the production cost. Therefore, considering industrial production, a lower limit of the O content is preferably 0.0001%, and more preferably 0.0003%.

The balance of the chemical composition of the steel material according to the present embodiment is Fe and impurities. Here, the term "impurities" refers to elements which, during industrial production of the steel material, are mixed in from ores and scrap as the raw material, or from the production environment or the like, and which are allowed within a range not adversely affecting the steel material according to the present embodiment.

[Regarding Optional Elements]

[First Group]

The steel material of the present embodiment may further contain one or more types of element selected from the group consisting of V and Nb in lieu of a part of Fe. Each of these elements is an optional element, and each of these elements forms precipitates and increases the strength of the steel material by precipitation strengthening.

V: 0 to 0.05%

Vanadium (V) is an optional element and does not have to be contained. That is, the V content may be 0%. When contained, that is, when the V content is more than 0%, V improves the hardenability. V also forms precipitates (carbides). The V precipitates increase the strength of the steel material by precipitation strengthening. However, in the chemical composition of the present embodiment, when the yield strength of the steel material is raised to 896 MPa or more (130 ksi or more), if the V content is more than 0.05%, V precipitates will markedly decrease the low-temperature toughness of the steel material even if the contents of other elements are within the range of the present embodiment. Accordingly, the V content is 0 to 0.05%. A lower limit of the V content is preferably 0.01%. An upper limit of the V content is preferably 0.04%, more preferably 0.03%, and further preferably 0.02%.

Nb: 0 to 0.010%

Niobium (Nb) is an optional element and does not have to be contained. That is, the Nb content may be 0%. When contained, that is, when the Nb content is more than 0%, Nb forms precipitates (carbo-nitrides). The Nb precipitates increase the strength of the steel material by precipitation strengthening. However, in the chemical composition of the present embodiment, when the yield strength of the steel material is raised to 896 MPa or more (130 ksi or more), if the Nb content is more than 0.010%, Nb precipitates will markedly decrease the low-temperature toughness of the steel material even if the contents of other elements are within the range of the present embodiment. Accordingly, the Nb content is 0 to 0.010%. A lower limit of the Nb content is preferably 0.001%, and more preferably 0.002%. An upper limit of the Nb content is preferably 0.009%, and more preferably 0.008%.

[Second Group]

The steel material of the present embodiment may also contain B in lieu of a part of Fe.

B: 0 To Less than 0.0005%

Boron (B) is an optional element and does not have to be contained. That is, the B content may be 0%. When contained, that is, when the B content is more than 0%, B dissolves in the steel material and increases the hardenability of the steel material, thereby increasing the strength of the steel material. When B is contained even in a small amount, the aforementioned effect will be obtained to some extent. However, in the chemical composition of the present embodiment, when the yield strength of the steel material is raised to 896 MPa or more (130 ksi or more), if the B content is 0.0005% or more, even if the contents of other elements are within the range of the present embodiment, B inclusions that form in the steel material will decrease the low-temperature toughness of the steel material. Accordingly, the B content is 0 to less than 0.0005%. An upper limit of the B content is preferably 0.0004%, and more preferably 0.0003%. A lower limit of the B content is preferably 0.0001%.

[Third group]

The steel material of the present embodiment may further contain one or more types of element selected from the group consisting of Ca, Mg and rare earth metal (REM) in lieu of a part of Fe. Each of these elements refines Mn sulfides in the steel material and thereby increases the low-temperature toughness of the steel material.

Ca: 0 to 0.0100%

Calcium (Ca) is an optional element and does not have to be contained. That is, the Ca content may be 0%. When contained, that is, when the Ca content is more than 0%, Ca refines Mn sulfides in the steel material and thereby increases the low-temperature toughness of the steel material. When Ca is contained even in a small amount, the aforementioned effect will be obtained to some extent. However, if the Ca content is more than 0.0100%, even if the contents of other elements are within the range of the present embodiment, oxides in the steel material will coarsen and the low-temperature toughness of the steel material will, on the contrary, decrease. Accordingly, the Ca content is 0 to 0.0100%. A lower limit of the Ca content is preferably 0.0001%, more preferably 0.0003%, further preferably 0.0006%, and further preferably 0.0010%. An upper limit of the Ca content is preferably 0.0060%, more preferably 0.0050%, further preferably 0.0040%, further preferably 0.0025%, and further preferably 0.0020%.

Mg: 0 to 0.0100%

Magnesium (Mg) is an optional element and does not have to be contained. That is, the Mg content may be 0%. When contained, that is, when the Mg content is more than 0%, Mg refines Mn sulfides in the steel material and thereby increases the low-temperature toughness of the steel material. When Mg is contained even in a small amount, the aforementioned effect will be obtained to some extent. However, if the Mg content is more than 0.0100%, even if the contents of other elements are within the range of the present embodiment, oxides in the steel material will coarsen and the low-temperature toughness of the steel material will, on the contrary, decrease. Accordingly, the Mg content is 0 to 0.0100%. A lower limit of the Mg content is preferably 0.0001%, more preferably 0.0003%, further preferably 0.0006%, and further preferably 0.0010%. An upper limit of the Mg content is preferably 0.0060%, more preferably 0.0050%, further preferably 0.0040%, further preferably 0.0025%, and further preferably 0.0020%.

Rare Earth Metal (REM): 0 to 0.0100%

Rare earth metal (REM) is an optional element and does not have to be contained. That is, the REM content may be 0%. When contained, that is, when the REM content is more than 0%. REM refines Mn sulfides in the steel material and thereby increases the low-temperature toughness of the steel material. When REM is contained even in a small amount, the aforementioned effect will be obtained to some extent. However, if the REM content is more than 0.0100%, even if the contents of other elements are within the range of the present embodiment, oxides in the steel material will coarsen and the low-temperature toughness of the steel material will, on the contrary, decrease. Accordingly, the REM content is 0 to 0.0100%. A lower limit of the REM content is preferably 0.0001%, more preferably 0.0003%, further preferably 0.0006%, and further preferably 0.0010%. An upper limit of the REM content is preferably 0.0060%, more preferably 0.0050%, further preferably 0.0040%, further preferably 0.0025%, and further preferably 0.0020%.

Note that, in the present description the term "REM" means one or more types of element selected from the group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. In the present description the term "REM content" refers to the total content of these elements.

[Fourth Group]

The chemical composition of the steel material described above may further contain one or more types of element selected from the group consisting of Ni and Cu in lieu of a part of Fe. Each of these elements is an optional element and increases the hardenability of the steel.

Ni: 0 to 0.50%

Nickel (Ni) is an optional element and does not have to be contained. That is, the Ni content may be 0%. When contained, that is, when the Ni content is more than 0%, Ni increases the hardenability of the steel, thereby increasing the strength of the steel material. When Ni is contained even in a small amount, the aforementioned effect will be obtained to some extent. However, if the Ni content is more than 0.50%, even if the contents of other elements are within the range of the present embodiment, Ni will promote local corrosion, and the corrosion resistance of the steel material will decrease. Accordingly, the Ni content is 0 to 0.50%. A lower limit of the Ni content is preferably 0.01%, and more preferably 0.02%. An upper limit of the Ni content is preferably 0.40%, more preferably 0.30%, further preferably 0.20%, further preferably 0.10%, further preferably 0.08%, and further preferably 0.06%.

Cu: 0 to 0.50%

Copper (Cu) is an optional element and does not have to be contained. That is, the Cu content may be 0%. When contained, that is, when the Cu content is more than 0%, Cu increases the hardenability of the steel, thereby increasing the strength of the steel material. When Cu is contained even in a small amount, the aforementioned effect will be obtained to some extent. However, if the Cu content is more than 0.50%, even if the contents of other elements are within the range of the present embodiment, the hardenability of the steel material will be too high and the low-temperature toughness of the steel material will decrease. Therefore, the Cu content is 0 to 0.50%. A lower limit of the Cu content is preferably 0.01%, and more preferably 0.02%. An upper limit of the Cu content is preferably 0.40%, more preferably 0.30%, further preferably 0.20%, further preferably 0.10%, further preferably 0.08%, and further preferably 0.06%.

[Regarding Grain Size Number of Prior-Austenite Grains]

In the microstructure of the steel material according to the present embodiment, the grain size number of prior-austenite grains is less than 7.0.

As mentioned above, in the steel material of the present embodiment, a strengthening mechanism that strengthens by improving the hardenability is adopted as the main strengthening mechanism. The coarser the grains of the steel material are, the more the hardenability of the steel material increases. In a steel material in which the content of each element in the chemical composition is within the range of the present embodiment, when the grain size number of prior-austenite grains is 7.0 or more, sufficient hardenability cannot be obtained. In this case, the strength of the steel material will be insufficient, and the yield strength of the steel material will be less than 896 MPa (130 ksi).

If the grain size number of the prior-austenite grains is less than 7.0, on the precondition that the content of each element in the chemical composition is within the range of the present embodiment and Formula (1) to Formula (4) are satisfied, the hardenability of the steel material will be sufficiently high. Therefore the strength of the steel material will sufficiently increase, specifically, the yield strength of the steel material will be 896 MPa (130 ksi) or more.

A lower limit of the grain size number of the prior-austenite grains is not particularly limited. When taking industrial production into consideration, a lower limit of the grain size number of the prior-austenite grains is, for example, 2.0, or for example 2.5, or for example 3.0, or for example 3.5, or for example 4.0.

The grain size number of the prior-austenite grains in the steel material of the present embodiment can be determined by the following method. A test specimen is taken from the steel material in a manner so that a cross section perpendicular to the longitudinal direction (rolling direction) of the steel material becomes the surface to be examined. If the steel material is a steel plate, the test specimen is taken from a center portion of the plate thickness. If the steel material is a steel pipe, the test specimen is taken from a center portion of the wall thickness. The taken test specimen is embedded in resin, and the surface to be examined is mirror polished. After the surface to be examined has been mirror polished, prior-austenite grain boundaries are revealed by the Bechet-Beaujard method in which the surface to be examined is etched with an aqueous solution saturated with picric acid. The surface to be examined on which the prior-austenite grain boundaries have been revealed is used to measure the grain size number of the prior-austenite grains in conformity with ASTM E112-13.

[Regarding Parameter Formulae]

On the precondition that the respective elements in the chemical composition of the steel material of the present embodiment are within the ranges of the present embodiment described above, the chemical composition also satisfies the following Formula (1) to Formula (4):

$$\{C+Mn/5+(Cu+Ni)/15+(Cr+Mo+V)/5+10\times B\}\times(7.0/GN)^{0.55}\geq 0.678 \quad (1)$$

$$\{Mn/5.5+10\times Ti+1.2\times V+15\times Nb+200\times B\}\times(7.0/GN)^{0.45}\leq 0.240 \quad (2)$$

$$10\times Ti+V+10\times Nb\geq 0.015 \quad (3)$$

$$(10\times Ti+1.2\times V+30\times Nb)/Mo\leq 0.205 \quad (4)$$

where, the content in mass % of a corresponding element is substituted for each symbol of an element, and the grain size number of prior-austenite grains is substituted for "GN".

Formula (1) to Formula (4) are each described hereunder.

[Regarding Formula (1)]

F1 is defined as $F1=\{C+Mn/5+(Cu+Ni)/15+(Cr+Mo+V)/5+10\times B\}\times(7.0/GN)^{0.45}$. F1 is an index of the hardenability of the steel material. Hardenability improving elements and the size of prior-austenite grains synergistically affect the hardenability. Each of C, Mn, Cu, Ni, Cr, Mo, V and B in F1 is a hardenability improving element. In addition, the term $(7.0/GN)^{0.45}$ in F1 indicates the degree to which the prior-austenite grain size contributes to the hardenability.

If F1 is less than 0.678, even if the content of each element in the chemical composition is within the range of the present embodiment and Formula (2) to Formula (4) are satisfied, the hardenability of the steel material will be insufficient. In this case, the yield strength of the steel material cannot be sufficiently increased. If the content of each element in the chemical composition of the steel material is within the range of the present embodiment and F1 is 0.678 or more, on the precondition that the chemical composition satisfies Formula (2) to Formula (4) that are described later, the strength of the steel material can be sufficiently increased. Specifically, the yield strength of the steel material can be made 896 MPa (130 ksi) or more.

A lower limit of Ft is preferably 0.680, more preferably 0.685, further preferably 0.690, and further preferably 0.695. An upper limit of F1 is not particularly limited. For example, the upper limit of F1 is 2.445. Note that, the F1 value is a value obtained by rounding off the fourth decimal place of an obtained value.

[Regarding Formula (2)]

F2 is defined as $F2=\{Mn/5.5+10\times Ti+1.2\times V+15\times Nb+200\times B\}\times(7.0/GN)^{0.45}$. F2 is an index of the low-temperature toughness of the steel material. Mn, Ti, V. Nb and B are inclusion/precipitate forming elements. When the content of each element in the chemical composition is within the range of the present embodiment, these inclusion/precipitate forming elements are likely to form inclusions (Mn inclusions, Ti inclusions, B inclusions) or precipitates (Ti precipitates, V precipitates, Nb precipitates). Specifically, Mn and B are likely to form inclusions. V and Nb are likely to form precipitates. Ti is likely to form inclusions and precipitates. In a case where the yield strength of a steel material in which the content of each element in the chemical composition is within the range of the present embodiment is made 896 MPa (130 ksi) or more, these inclusions and precipitates together cause the low-temperature toughness of the steel material to markedly decrease.

In addition, the size of prior-austenite grains also affects the low-temperature toughness of the steel material. Specifically, if prior-austenite grains are coarse, cracks which were initiated from inclusions and precipitates are likely to propagate. On the other hand, if prior-austenite grains are fine, the propagation of cracks can be suppressed. Thus, inclusions and precipitates and the size of prior-austenite grains synergistically affect the low-temperature toughness.

If F2 is more than 0.240, even if the content of each element in the chemical composition is within the range of the present embodiment and Formula (1), Formula (3) and Formula (4) are satisfied, an excessively large amount of inclusions and/or precipitates containing Mn, Ti, V, Nb and B will form in the steel material. Alternatively the prior-austenite grains will become too large relative to the formed amount of inclusions and/or precipitates. Therefore, in a case where the yield strength of the steel material is made 896 MPa (130 ksi) or more, the low-temperature toughness of the steel material will decrease.

If F2 is 0.240 or less, in the steel material, the formation of inclusions and/or precipitates containing Mn, Ti, V, Nb and B can be sufficiently suppressed, and the size of the prior-austenite grains relative to the formed amount of inclusions and precipitates will also be appropriate. Therefore, on the precondition that the content of each element in the chemical composition is within the range of the present embodiment and the chemical composition satisfies Formula (1), Formula (3) and Formula (4), even when the yield strength of the steel material is made 896 MPa (130 ksi) or more, excellent low-temperature toughness is obtained.

An upper limit of F2 is preferably 0.235, more preferably 0.230, further preferably 0.225, further preferably 0.220, further preferably 0.215, further preferably 0.210, and further preferably 0.200. A lower limit of F2 is not particularly limited. For example, the lower limit of F2 is 0.019. Note that, the F2 value is a value obtained by rounding off the fourth decimal place of an obtained value.

[Regarding Formula (3)]

F3 is defined as $F3=10\times Ti+V+10\times Nb$. F3 is an index of precipitation strengthening that is employed in an auxiliary manner as a strengthening mechanism in a steel material in which the content of each element in the chemical composition is within the range of the present embodiment. In the steel material of the present embodiment, as mentioned above, a strengthening mechanism that strengthens by improving the hardenability is adopted as the main strengthening mechanism of the steel material. Specifically, by the content of each element in the chemical composition being within the range of the present embodiment, and Formula (1) being satisfied, the hardenability of the steel material is increased and thus the strength of the steel material is increased. However, in a steel material in which the content of each element in the chemical composition is within the range of the present embodiment, in some cases a high yield strength of 896 MPa (130 ksi) or more cannot be stably obtained only by a strengthening mechanism that strengthens by improving the hardenability.

Therefore, in the present embodiment, while adopting a strengthening mechanism that strengthens by improving the hardenability as the main strengthening mechanism, a precipitation strengthening mechanism that strengthens by precipitation of Ti, V and Nb is also employed as an auxiliary strengthening mechanism. Specifically, if F3 that is composed of Ti, V and Nb is less than 0.015, even if the content of each element in the chemical composition is within the range of the present embodiment and Formula (1), Formula (2) and Formula (4) are satisfied, the strength of the steel material will be insufficient. In this case, the yield strength of the steel material will be less than 896 MPa (130 ksi).

If F3 is 0.015 or more, precipitation strengthening by Ti, V and Nb can be utilized in an auxiliary manner. Therefore, on the precondition that the content of each element in the chemical composition is within the range of the present embodiment, and Formula (1), Formula (2) and Formula (4) are satisfied, the yield strength of the steel material will increase sufficiently. Specifically, the yield strength of the steel material will be 896 MPa (130 ksi) or more.

A lower limit of F3 is preferably 0.020, more preferably 0.025, further preferably 0.030, further preferably 0.035, further preferably 0.040, and further preferably 0.045. An upper limit of F3 is not particularly limited. If the content of each element in the chemical composition is within the range of the present embodiment, the upper limit value of F3 is, for example, 0.300. The upper limit of F3 is preferably 0.290, more preferably 0.260, further preferably 0.240, and further preferably 0.220. Note that, the F3 value is a value obtained by rounding off the fourth decimal place of an obtained value.

[Regarding Formula (4)]

F4 is defined as $F4=(10\times Ti+1.2\times V+30\times Nb)/Mo$. F4 is an index that indicates the degree to which Mo contributes to improving the low-temperature toughness.

As mentioned above, in the steel material of the present embodiment, the low-temperature toughness of the steel material is increased by reducing inclusions and precipitates as much as possible while increasing the strength of the steel material by adopting a strengthening mechanism that strengthens by improving the hardenability as the main strengthening mechanism of the steel material. However, in some cases a high yield strength of 896 MPa (130 ksi) or more cannot be stably obtained only by increasing the strength of the steel material by means of only a strengthening mechanism that strengthens by improving the hardenability. Therefore, a precipitation strengthening mechanism that strengthens by means of precipitates of Ti, V and Nb is employed in an auxiliary manner together with the strengthening mechanism that strengthens by improving the hardenability.

However, if precipitates of Ti, V and Nb are increased, the low-temperature toughness of the steel material in which the content of each element in the chemical composition is within the range of the present embodiment will decrease. On the other hand, Mo not only increases the strength of the steel material by improving the hardenability, but also strengthens the steel material by solid-solution strengthening. Solid-solution strengthening by Mo can suppress a decrease in the low-temperature toughness caused by Ti, V and Nb precipitates. Therefore, in the present embodiment, the ratio of the Mo content with respect to the content of Ti, V and Nb is increased. When F4 is more than 0.205, the ratio of the Mo content with respect to the content of Ti, V and Nb is low. In this case, although the yield strength of the steel material is made sufficiently high such that the yield strength of the steel material becomes 896 MPa (130 ksi) or more by the content of each element in the chemical composition being within the range of the present embodiment and the chemical composition satisfying Formulae (1) to (3), sufficient low-temperature toughness is not obtained.

When F4 is 0.205 or less, the ratio of the Mo content with respect to the content of Ti, V and Nb is high. In this case, on the precondition that the content of each element in the chemical composition is within the range of the present embodiment and Formula (1) to Formula (3) are satisfied, the yield strength of the steel material is sufficiently increased to make the yield strength of the steel material 896 MPa (130 ksi) or more, and excellent low-temperature toughness is also obtained.

An upper limit of F4 is preferably 0.202, more preferably 0.200, further preferably 0.198, further preferably 0.195, further preferably 0.190, further preferably 0.185, further preferably 0.180, and further preferably 0.175. A lower limit of F4 is not particularly limited. If the content of each element of the chemical composition is within the range of the present embodiment, the lower limit of F4 is, for example, 0.005. The lower limit of F4 is more preferably 0.010, and further preferably 0.012. Note that, the F4 value is a value obtained by rounding off the fourth decimal place of an obtained value.

[Regarding Yield Strength of Steel Material]

With respect to the steel material of the present embodiment composed as described above, on the precondition that the content of each element in the chemical composition is within the range of the present embodiment, the grain size number of prior-austenite grains is less than 7.0, by satisfying Formula (1) to Formula (4) the steel material has high yield strength. Specifically, the steel material of the present embodiment has a yield strength of 896 MPa (130 ksi) or more. The term "yield strength" as used in the present description means stress at a time of 0.65% total elongation (0.65% proof stress) obtained in a tensile test.

A lower limit of the yield strength is preferably 900 MPa, more preferably 910 MPa, and further preferably 920 MPa. An upper limit of the yield strength is not particularly limited. The upper limit of the yield strength, for example, is 1103 MPa (160 ksi), or for example is 1090 MPa, or for example is 1069 MPa (155 ksi).

The yield strength of the steel material of the present embodiment can be determined by the following method. A tensile test is performed by a method conforming to ASTM E8/E8M (2013). Specifically, a round bar specimen is taken from the steel material. If the steel material is a steel plate, the round bar specimen is taken from a center portion of the plate thickness. If the steel material is a steel pipe, the round bar specimen is taken from a center portion of the wall thickness. For example, the diameter of the parallel portion of the round bar specimen is 6.35 mm, and the length of the parallel portion is 25.4 mm. Note that the axial direction of the round bar specimen is parallel with the longitudinal direction (rolling direction) of the steel material. The tensile test is carried out in the atmosphere at normal temperature (25° C.) using the round bar specimen, and the obtained stress at a time of 0.65% total elongation (0.65% proof stress) is defined as the yield strength (MPa).

[Regarding Low-Temperature Toughness of Steel Material]

In the steel material according to the present embodiment, on the precondition that the content of each element in the chemical composition is within the range of the present embodiment, the grain size number of prior-austenite grains is less than 7.0, by satisfying Formula (1) to Formula (4) the aforementioned high yield strength and excellent low-temperature toughness can both be achieved. Specifically, in the steel material according to the present embodiment the absorbed energy at −10° C. is 95 J or more. More specifically, the absorbed energy at −10° C. in conformity with ASTM E23 (2018) is 95 J or more.

A lower limit of the absorbed energy at −10° C. is preferably 96 J, more preferably 98 J, and further preferably 100 J. An upper limit of the absorbed energy at −10° C. is not particularly limited. The upper limit of the absorbed energy is, for example, 200 J, or for example is 180 J, or for example is 160 J.

The absorbed energy at −10° C. can be determined by the following method. The steel material of the present embodiment is subjected to a Charpy impact test conforming to ASTM E23 (2018) to evaluate the low-temperature toughness. Specifically, V-notch test specimens are taken from the steel material. If the steel material is a steel plate, the V-notch test specimens are taken from a center portion of the plate thickness. If the steel material is a steel pipe, the V-notch test specimens are taken from a center portion of the wall thickness. The V-notch test specimens are prepared in accordance with API specification 5CT (10th edition). The Charpy impact test is conducted at −10° C. in accordance with ASTM E23 (2018) using three of the V-notch test specimens as one set to measure the absorbed energy. In a case where the absorbed energy is measured using sub-size test specimens, the obtained absorbed energy is divided by a reduction factor described in API specification 5CT (10th edition) to convert the obtained value to the absorbed energy for full-size test specimens. The arithmetic mean value of the absorbed energy values of the three V-notch test specimens is defined as the absorbed energy E (J) at −10° C. Note that the absorbed energy E (J) at −10° C. is a value obtained by rounding off the first decimal place of an obtained numerical value.

[Microstructure]

The microstructure of the steel material according to the present embodiment is mainly composed of martensite and/or bainite. More specifically, in the microstructure, the total area fraction of martensite and bainite is 90% or more. The balance of the microstructure is composed of, for example, ferrite and/or pearlite. Although in some cases the balance of the microstructure may also include retained austenite in addition to ferrite and/or pearlite, the area of retained austenite is negligible compared to the area of martensite, bainite, ferrite and pearlite. If the total area fraction of martensite and bainite in the microstructure of the steel material having the above described chemical composition is 90% or more, on the condition that the other requirements of the present embodiment are satisfied, the yield strength of the steel material will be 896 MPa or more (130 ksi or more). That is, in the present embodiment, if the contents of the respective elements in the chemical composition are within the ranges described above, the grain size number of prior-austenite grains is less than 7.0, Formula (1) to Formula (4) are satisfied, and the yield strength of the steel material is 896 MPa or more, it can be determined that the total area fraction of martensite and bainite in the microstructure is 90% or more.

When determining the total area fraction of martensite and bainite through observation, the total area fraction can be determined by the following method. If the steel material is a steel plate, a test specimen having an observation surface including the rolling direction and the thickness direction is taken from a center portion of the plate thickness. If the steel material is a steel pipe, a test specimen having an observation surface including the pipe axis direction and the wall thickness (pipe diameter) direction is taken from a center portion of the wall thickness.

After polishing the observation surface of the test specimen to a mirror finish, the test specimen is immersed for 10 seconds in a nital etching reagent to reveal the microstructure by etching. A scanning electron microscope (SEM) is used to observe 10 visual fields of the etched observation surface using a secondary electron image. The visual field area is, for example, 0.01 $mm^2$ (magnification of 1000×). In each visual field, martensite and bainite are identified based on contrast. Those skilled in the art can easily distinguish martensite and bainite from other phases (ferrite and pearlite) based on contrast. Note that, in the present embodiment, because the total area fraction of martensite and bainite is to be determined, it is not necessary to distinguish between martensite and bainite.

The total area fraction (%) of the identified martensite and bainite is then determined. In the present embodiment, the arithmetic mean value of the total area fraction (%) of martensite and bainite determined in all the visual fields is defined as the total area fraction (%) of martensite and bainite.

[Preferable Number Density of Mn Sulfides]

In the present embodiment, an Mn sulfide is defined as follows. In a case where all elements (however, excluding C) detected in an element concentration analysis performed by energy dispersive X-ray spectrometry (hereunder, also referred to as "EDS") are quantified, an inclusion in which, in mass %, an Mn content of 20% or more is detected and an S content of 10% or more is detected is defined as an "Mn sulfide". In addition, in the present embodiment, an Mn sulfide having an equivalent circular diameter of 5.0 μm or more is defined as a "coarse Mn sulfide".

In the steel material of the present embodiment, on the precondition that the content of each element in the chemical composition is within the range of the present embodiment, the grain size number of prior-austenite grains is less than 7.0, and Formula (1) to Formula (4) are satisfied, a preferable number density of coarse Mn sulfides is 10/100 $mm^2$ or less. In this case, while making the yield strength of the steel material 896 MPa or more, the absorbed energy at −10° C. can be made 100 J or more.

The number density of coarse Mn sulfides can be determined by the following method. Specifically, if the steel material is a steel plate, a test specimen is taken from a center portion of the plate thickness. If the steel material is a steel pipe, a test specimen is taken from a center portion of the wall thickness. If the steel material is a steel plate, the taken test specimen is embedded in resin in a manner so that a face of the test specimen which includes the rolling direction and thickness direction becomes the observation surface. If the steel material is a steel pipe, the taken test specimen is embedded in resin in a manner so that a face of the test specimen which includes the pipe axis direction and wall thickness (pipe diameter) direction becomes the observation surface. The observation surface of the test specimen that is embedded in resin is then polished. An arbitrary 10 visual fields on the observation surface after polishing are observed. The area of each visual field is set to, for example, 100 $mm^2$.

In each visual field, the number of Mn sulfides having an equivalent circular diameter of 5.0 μm or more is determined. Specifically, inclusions in each visual field are identified based on contrast. The identified inclusions are each subjected to an element concentration analysis (EDS analysis). When all the detected elements (however, excluding C) are quantified, inclusions in which, in mass %, an Mn content of 20% or more is detected and an S content of 10% or more is detected are specified as "Mn sulfides".

Among the Mn sulfides specified in the 10 visual fields, the total number of Mn sulfides having an equivalent circular diameter of 5.0 μm or more (coarse Mn sulfides) is determined. The number density of coarse MVI/n sulfides (/100 $mm^2$) is determined based on the total number of coarse Mn sulfides and the total area of the 10 visual fields. In the present embodiment, when determining the number density of coarse Mn sulfides (/100 $mm^2$), the first decimal place of an obtained numerical value is rounded off. Note that, measurement of the number density of coarse Mn sulfides can also be performed using an apparatus in which a scanning electron microscope is provided with a composition analysis function (SEM-EDS apparatus).

A preferable upper limit of the number density of coarse Mn sulfides is 9/100 $mm^2$, and more preferably is 8/100 $mm^2$

[Shape of Steel Material]

The shape of the steel material according to the present embodiment is not particularly limited. The steel material is, for example, a steel pipe or a steel plate. The steel material is, for example, an oil-well steel pipe. The oil-well steel pipe is, for example, a casing pipe, a tubing pipe, a drilling pipe or the like which is used for drilling of an oil well or a gas well, collection of crude oil or natural gas, and the like.

The oil-well steel pipe may be a welded steel pipe or may be a seamless steel pipe. Preferably, the steel material of the present embodiment is an oil-well seamless steel pipe. The term "oil-well seamless steel pipe" means an oil-well steel pipe that is a seamless steel pipe.

[Production Method]

A method for producing the steel material according to the present embodiment will now be described. In the following description, a method for producing a steel pipe as one example of the steel material according to the present embodiment is described. However, a method for producing the steel material according to the present embodiment is not limited to the production method described hereunder. That is, the production method is not particularly limited and may be a different production method as long as a steel material composed as described above can be produced.

One example of the method for producing the steel material according to the present embodiment includes a process of preparing a starting material (starting material preparation process), a process of heating the prepared starting material (heating process), a process of subjecting the heated starting material to hot working (hot working process), and a process of subjecting the steel material after hot working to quenching and tempering (heat treatment process). Each process is described in detail hereunder.

[Starting Material Preparation Process]

In the starting material preparation process, molten steel in which the content of each element in the chemical composition is within the range of the present embodiment, and which satisfies Formula (1) to Formula (4) when made into a steel material is produced by a well-known steel-making method. A cast piece is produced by a continuous casting process using the produced molten steel. Here, the cast piece is a slab, a bloom, or a billet. Instead of the cast piece, an ingot may be produced by an ingot-making process using the aforementioned molten steel. As needed, the slab, the bloom, or the ingot may be subjected to hot working to produce a billet. The starting material (slab, bloom, or billet) is produced by the above described production process.

[Heating Process]

In the heating process, the starting material prepared in the starting material preparation process is charged into a continuous heating furnace and heated. The heating furnace may be a rotary hearth heating furnace or may be a walking beam heating furnace. In the following description, the use of a rotary hearth heating furnace is described as one example of a continuous heating furnace.

FIG. 1 is a schematic diagram (plan view) illustrating a rotary hearth heating furnace that is one example of a continuous heating furnace. Referring to FIG. 1, a heating furnace 10 includes a furnace main body 13 having a charging port 11 and an extraction port 12. A billet B1 as a starting material which is the object to be heated is charged into the heating furnace 10 from the charging port 11. In FIG. 1, the billet B1 is heated while moving through the inside of the heating furnace 10. In FIG. 1, the billet B1 charged into the charging port 11 moves in the clockwise direction. When the billet B1 which is heated while moving arrives at the extraction port 12, the billet B1 is extracted to outside from the extraction port 12.

The furnace main body 13 is divided into a preheating zone Z1, a heating zone Z2, and a soaking zone Z3 in that order in the direction from the charging port 11 toward the extraction port 12. The preheating zone Z1 is a zone that has the charging port 11, and is the zone in which the in-furnace temperature is lowest among the three zones (preheating zone Z1, heating zone Z2 and soaking zone Z3). The heating zone Z2 is a zone arranged between the preheating zone Z1 and the soaking zone Z3. The soaking zone Z3 is a zone that follows the heating zone Z2, and has the extraction port 12 at the rear end thereof. The heating zone Z2 and the soaking zone Z3 are maintained at approximately the same temperature.

Specifically, although the temperature in the soaking zone Z3 is somewhat higher than the temperature in the heating zone Z2, the temperature difference between the soaking zone Z3 and the heating zone Z2 is 20° C. or less. One or a plurality of burners is provided in each of the zones. In each zone, the temperature is adjusted by means of the burner(s).

In the present embodiment the temperature and residence time in the preheating zone Z1, the heating zone Z2 and the soaking zone Z3 are as follows.

[Preheating Zone Z1]

In the preheating zone Z1, an in-furnace temperature T1 is 820 to 1300° C., and the temperature in the preheating zone Z1 is set lower than an in-furnace temperature T2 in the heating zone Z2 and the soaking zone Z3. In addition, a residence time t1 of the starting material in the preheating zone Z1 is set to 45 minutes or more. The term "residence time t1" means a time (minutes) from when the starting material enters the preheating zone Z1 from the charging port 11 until the starting material is discharged into the heating zone Z2. The preheating zone Z1 mainly plays a role of increasing the temperature of the starting material that is at normal temperature. Preferably, the residence time t1 in the preheating zone Z1 is set to 50 minutes or more, and more preferably is set to 55 minutes or more. An upper limit of the residence time t1 is not particularly limited. However, in consideration of productivity, a preferable upper limit of the residence time t1 is 300 minutes.

[Heating Zone Z2 and Soaking Zone Z3]

In the heating zone Z2 and the soaking zone Z3, an in-furnace temperature T2 is set to 1100 to 1380° C., and the temperature in the heating zone Z2 and the soaking zone Z3 is set to a higher temperature than the in-furnace temperature in the preheating zone Z1. Here, an arithmetic mean value of an in-furnace temperature in the heating zone Z2 and an in-furnace temperature in the soaking zone Z3 is adopted as the in-furnace temperature T2. Further, a total residence time t2 (minutes) in the heating zone Z2 and the soaking zone Z3 is set to 50 minutes or more, and more preferably is set to 55 minutes or more. Here, the term "total residence time t2" means a time (minutes) from when the starting material enters the heating zone Z2 until the starting material is discharged to outside from the extraction port 12. An upper limit of the total residence time t2 is not particularly limited. However, in consideration of productivity, a preferable upper limit of the total residence time t2 is 600 minutes.

[Preferable Conditions in Heating Zone Z2 and Soaking Zone Z3]

Preferably, the in-furnace temperature T2 and the total residence time t2 in the heating zone Z2 and the soaking zone Z3 satisfy the following Formula (A):

$$1420 \leq (t2/60)^{0.5} \times (T2+273) \quad \text{(A)}$$

where, in Formula (A), the total residence time t2 (minutes) of the starting material is substituted for "t2", and the in-furnace temperature T2 (° C.) is substituted for "T2".

FA is defined as $FA=(t2/60)^{0.5}\times(T2+273)$. If FA is 1420 or more, Mn contained in the starting material will sufficiently diffuse in the starting material overall. In this case, some of the Mn sulfides in the starting material will dissolve. In addition, formation of coarse Mn sulfides will be suppressed. As a result, the number density of Mn sulfides having an equivalent circular diameter of 5 μm or more will be 10/100 $mm^2$ or less.

A lower limit of FA is preferably 1500, more preferably 1550, further preferably 1600, further preferably 1650, and further preferably 1700. An upper limit of FA is not particularly limited. However, in consideration of the facility load and the specific productivity of production, the upper limit of FA is preferably 4500, more preferably 4400, further preferably 4300, and further preferably 4200.

Note that, a lower limit of the total furnace time in the preheating zone Z1, the heating zone Z2, and the soaking zone Z3 is preferably 95 minutes, more preferably 120 minutes, further preferably 140 minutes, further preferably 150 minutes, and further preferably 160 minutes. An upper limit of the total furnace time is preferably 900 minutes, more preferably 800 minutes, and further preferably 750 minutes.

Note that, in FIG. 1, the preheating zone Z1, the heating zone Z2 and the soaking zone Z3 are equally divided inside the furnace main body 13. However, the preheating zone Z1, the heating zone Z2 and the soaking zone Z3 do not have to be equally divided.

[Hot Working Process]

In the hot working process, the starting material heated under the aforementioned conditions by the heating process is subjected to hot working. If the end product is a steel pipe, the heated starting material is subjected to hot working to produce an intermediate steel material (hollow shell). For example, hot rolling by the Mannesmann-mandrel process is performed as the hot working to produce a hollow shell. In this case, the billet is subjected to piercing-rolling by a piercing machine. When performing piercing-rolling, although not particularly limited, the piercing ratio is, for example, 1.0 to 4.0. The billet after piercing-rolling is subjected to rolling using a mandrel mill. In addition, as needed, the billet after rolling is subjected to diameter adjusting rolling using a reducer or a sizing mill. A hollow shell is produced by the above process.

Hot extrusion may be performed as hot working. For example, the Ugine-Sejournet process or the Ehrhardt push bench process may be performed to produce a hollow shell.

[Preferable Working Time]

Preferably, the working time in the hot working process according to the present embodiment is 15 minutes or less. Here, the term "working time (minutes)" means a time period from when the starting material is extracted from the heating furnace until the final hot working ends. If the working time is 15 minutes or less, on the precondition that the aforementioned Formula (A) is satisfied, coarse growth of Mn sulfides and formation of new Mn sulfides during the hot working can be suppressed. As a result, the number density of Mn sulfides having an equivalent circular diameter of 5 μm or more will be 10/100 $mm^2$ or less.

A more preferable upper limit of the working time is 14 minutes, and further preferably is 13 minutes. A lower limit of the working time is not particularly limited, and for example is 5 minutes.

[Heat Treatment Process]

In the heat treatment process, the intermediate steel material (hollow shell) after the hot working is subjected to a quenching process and a tempering process.

[Quenching Process]

In the quenching process, "in-line quenching" or "off-line quenching" is performed. Here, a treatment in which direct quenching is performed after hot working without cooling the intermediate steel material (hollow shell) produced by hot working to normal temperature, or in which quenching is performed after subjecting the intermediate steel material (hollow shell) to supplementary heating (reheating) at a time which is after hot working and is before the intermediate steel material (hollow shell) is cooled to normal temperature is referred to as "in-line quenching". In the case of in-line quenching, quenching can be performed immediately after hot working on the production line. On the other hand, a treatment in which the intermediate steel material (hollow shell) after hot working is cooled to normal temperature and thereafter is subjected to quenching using a heat treatment furnace is referred to as "off-line quenching". Hereunder, in-line quenching and off-line quenching are described.

[in-Line Quenching]

The quenching temperature in the in-line quenching is 800 to 1100° C. As used in the present description, in a case where direct quenching is performed after hot working, the term "quenching temperature" corresponds to the surface temperature of the intermediate steel material that is measured by a thermometer placed on the exit side of the apparatus that performs the final hot working. In a case where quenching is performed using a supplementary heating furnace or a heat treatment furnace after hot working, the "quenching temperature" corresponds to the temperature of the supplementary heating furnace or the heat treatment furnace.

As mentioned above, in-line quenching may be performed by rapidly cooling the intermediate steel material that is at a temperature of 800 to 1100° C. after hot working. Alternatively, the intermediate steel material that is in a state after hot working and before being cooled to normal temperature (intermediate steel material whose temperature is 400° C. or more) may be heated to 800 to 1100° C. using a supplementary heating furnace or a heat treatment furnace installed on the production line, and thereafter rapidly cooled. An upper limit of the quenching temperature in the in-line quenching is preferably 1050° C., more preferably 1000° C., and further preferably 980° C. A lower limit of the quenching temperature in the in-line quenching is preferably 850° C., and more preferably 900° C.

In the case of performing in-line quenching using a supplementary heating furnace or a heat treatment furnace after hot working, the holding time at the quenching temperature is, for example, 5 to 45 minutes.

The quenching method is, for example, a method that rapidly cools the hollow shell from the quenching temperature. It suffices that the rapid cooling method is a well-known method. The rapid cooling method is, for example, a method in which the hollow shell is cooled by being immersed in a water bath, or a method in which the hollow shell is cooled by shower water cooling or mist cooling.

[Off-Line Quenching]

The quenching temperature in the off-line quenching is 930 to 1100° C. In addition, the holding time at the quenching temperature is 10 to 125 minutes.

When quenching is performed off-line, grains are refined by reverse transformation. Therefore, if the quenching temperature is too low, even if the content of each element in the chemical composition is within the range of the present embodiment, in some cases the grain size number of prior-austenite grains will be 7.0 or more. If the quenching temperature is 930 to 1100° C. and the holding time at the quenching temperature is 10 to 125 minutes, austenite grains can be made coarse during the quenching. As a result, on the precondition that a requirement regarding the holding time to be described later is satisfied, the grain size number of prior-austenite grains can be made less than 7.0. A lower limit of the quenching temperature in the off-line quenching is preferably 940° C., and more preferably 950° C. An upper limit of the quenching temperature in the off-line quenching is preferably 1050° C.

[Tempering Process]

In the tempering process, the intermediate steel material after the quenching process is subjected to tempering. In the present embodiment, precipitates which contribute to precipitation strengthening are formed in the steel material during the tempering process. By this means, together with a strengthening mechanism that strengthens by improving the hardenability, a precipitation strengthening mechanism is employed in an auxiliary manner to sufficiently increase the strength of the steel material. Specifically, the yield strength of the steel material is made 896 MPa (130 ksi) or more. In addition, by adopting appropriate tempering conditions, strain in the steel material is reduced and the low-temperature toughness is increased. The absorbed energy E (J) at −10° C. is made 95 J or more.

Specifically, in the tempering process, a tempering parameter TMP defined by the following formula is made to fall within the range of 17000 to 17950.

$$TMP=(\text{tempering temperature } (^\circ\text{ C.})+273)\times(20+\log(\text{holding time (minutes)}/60))$$

If the tempering parameter TMP is less than 17000, the effect of tempering will not be sufficiently obtained, and strain introduced into the steel material in the quenching process will not be sufficiently removed. In this case, even if the content of each element in the chemical composition is within the range of the present embodiment, the grain size number of prior-austenite grains is less than 7.0, and Formula (1) to Formula (4) are satisfied, the absorbed energy E (J) at −10° C. will be less than 95 J. On the other hand, if the tempering parameter TMP is more than 17950, sufficient strength cannot be obtained. Consequently, even if the content of each element in the chemical composition is within the range of the present embodiment, the grain size number of prior-austenite grains is less than 7.0, and Formula (1) to Formula (4) are satisfied, the yield strength will be less than 896 MPa (130 ksi).

If the tempering parameter TMP is 17000 to 17950, excessive strain introduced during quenching can be appropriately removed while appropriately forming precipitates that contribute to precipitation strengthening. As a result, on the precondition that the content of each element in the chemical composition is within the range of the present embodiment, the grain size number of prior-austenite grains is less than 7.0, and Formula (1) to Formula (4) are satisfied, sufficient high strength is obtained and excellent low-temperature toughness is also obtained. Specifically, the yield strength of the steel material will be 896 MPa (130 ksi) or more, and the absorbed energy E (J) at −10° C. will be 95 J or more.

The tempering temperature in the tempering process is 600 to 720° C. In addition, the holding time at the tempering temperature is 10 to 90 minutes. That is, in the tempering process, the tempering temperature is set to 600 to 720° C., the holding time at the tempering temperature is set to 10 to 90 minutes and, in addition, the tempering parameter TMP is made 17000 to 17950.

A lower limit of the tempering temperature is preferably 605° C., and more preferably 610° C. An upper limit of the tempering temperature is preferably 700° C. more preferably 680° C., and further preferably 660° C. A lower limit of the tempering parameter TMP is preferably 17050, more preferably 17100, and further preferably 17130. An upper limit of the tempering parameter TMP is preferably 17940, more preferably 17920, and further preferably 17910.

The steel material according to the present embodiment can be produced by the above production process. Note that, in the production method described above, a method for producing a steel pipe is described as one example. However, the steel material according to the present embodiment may also be a steel plate. Similarly to the production method described above, an example of a method for producing a steel plate also includes, for example, a starting material preparation process, a heating process, a hot working process, and a heat treatment process. Note that, even when another production method is employed, the production method is not particularly limited as long as a steel material composed as described above can be produced.

Example

The advantageous effects of the steel material of the present embodiment will be described more specifically by way of an example. The conditions adopted in the following example are one example of conditions employed for confirming the feasibility and advantageous effects of the steel material of the present embodiment. Accordingly, the steel material of the present embodiment is not limited to this one example of the conditions.

Molten steels having the chemical compositions shown in Table 1 were produced. Note that a blank field in Table 1 means that the corresponding element was not contained. For example, in the case of Test No. 1, with respect to the V content, the blank field means that as the result of rounding off the third decimal place, the V content was "0" %. Further, with respect to the Nb content, the blank field means that as the result of rounding off the fourth decimal place, the Nb content was "0" %. The same also applies with respect to the contents of the other elements.

TABLE 1

| Test | Chemical Composition (unit is mass %; balance is Fe and impurities) | | | | | | | | | |
|---|---|---|---|---|---|---|---|---|---|---|
| No. | C | Si | Mn | P | S | Al | Cr | Mo | N | O |
| 1 | 0.25 | 0.21 | 0.43 | 0.010 | 0.0019 | 0.026 | 1.15 | 0.59 | 0.0047 | 0.0014 |
| 2 | 0.28 | 0.22 | 0.50 | 0.007 | 0.0013 | 0.026 | 1.15 | 0.83 | 0.0027 | 0.0012 |
| 3 | 0.28 | 0.22 | 0.49 | 0.007 | 0.0019 | 0.030 | 1.00 | 0.57 | 0.0030 | 0.0013 |
| 4 | 0.28 | 0.21 | 0.49 | 0.007 | 0.0019 | 0.030 | 1.00 | 0.57 | 0.0030 | 0.0013 |
| 5 | 0.26 | 0.21 | 0.45 | 0.007 | 0.0020 | 0.031 | 0.97 | 0.52 | 0.0038 | 0.0012 |
| 6 | 0.28 | 0.22 | 0.49 | 0.007 | 0.0019 | 0.030 | 1.00 | 0.57 | 0.0030 | 0.0013 |
| 7 | 0.28 | 0.23 | 0.50 | 0.007 | 0.0017 | 0.026 | 1.15 | 0.63 | 0.0027 | 0.0012 |
| 8 | 0.25 | 0.32 | 0.43 | 0.010 | 0.0035 | 0.036 | 1.15 | 0.52 | 0.0047 | 0.0014 |
| 9 | 0.26 | 0.21 | 0.54 | 0.009 | 0.0025 | 0.033 | 0.97 | 0.48 | 0.0050 | 0.0017 |
| 10 | 0.26 | 0.21 | 0.54 | 0.009 | 0.0025 | 0.033 | 0.97 | 0.48 | 0.0050 | 0.0017 |
| 11 | 0.26 | 0.21 | 0.54 | 0.009 | 0.0025 | 0.033 | 0.97 | 0.48 | 0.0050 | 0.0017 |
| 12 | 0.26 | 0.21 | 0.54 | 0.009 | 0.0025 | 0.034 | 0.98 | 0.49 | 0.0050 | 0.0016 |
| 13 | 0.26 | 0.21 | 0.54 | 0.009 | 0.0025 | 0.033 | 0.97 | 0.48 | 0.0050 | 0.0017 |
| 14 | 0.28 | 0.25 | 0.60 | 0.007 | 0.0030 | 0.036 | 1.05 | 0.60 | 0.0050 | 0.0015 |
| 15 | 0.28 | 0.25 | 0.60 | 0.007 | 0.0030 | 0.036 | 1.05 | 0.60 | 0.0050 | 0.0015 |
| 16 | 0.26 | 0.25 | 0.50 | 0.007 | 0.0030 | 0.035 | 0.95 | 0.50 | 0.0050 | 0.0015 |
| 17 | 0.26 | 0.25 | 0.50 | 0.007 | 0.0030 | 0.035 | 0.95 | 0.50 | 0.0050 | 0.0015 |
| 18 | 0.26 | 0.25 | 0.50 | 0.007 | 0.0030 | 0.035 | 0.95 | 0.50 | 0.0050 | 0.0015 |
| 19 | 0.28 | 0.25 | 0.60 | 0.007 | 0.0030 | 0.036 | 1.05 | 0.60 | 0.0050 | 0.0015 |

TABLE 1-continued

| | | | | | | | | | | |
|---|---|---|---|---|---|---|---|---|---|---|
| 20 | 0.26 | 0.23 | 0.55 | 0.008 | 0.0030 | 0.033 | 0.99 | 0.51 | 0.0050 | 0.0016 |
| 21 | 0.26 | 0.21 | 0.54 | 0.007 | 0.0017 | 0.031 | 0.97 | 0.52 | 0.0050 | 0.0015 |
| 22 | 0.26 | 0.21 | 0.54 | 0.007 | 0.0017 | 0.031 | 0.97 | 0.52 | 0.0050 | 0.0015 |
| 23 | 0.26 | 0.21 | 0.54 | 0.008 | 0.0035 | 0.033 | 0.97 | 0.52 | 0.0050 | 0.0016 |
| 24 | 0.26 | 0.21 | 0.54 | 0.008 | 0.0035 | 0.033 | 0.97 | 0.52 | 0.0050 | 0.0016 |
| 25 | 0.26 | 0.21 | 0.54 | 0.008 | 0.0035 | 0.033 | 0.97 | 0.52 | 0.0050 | 0.0016 |
| 26 | 0.26 | 0.21 | 0.54 | 0.009 | 0.0025 | 0.033 | 0.80 | 0.45 | 0.0050 | 0.0017 |
| 27 | 0.26 | 0.21 | 0.54 | 0.009 | 0.0025 | 0.033 | 0.80 | 0.45 | 0.0050 | 0.0017 |
| 28 | 0.26 | 0.21 | 0.79 | 0.012 | 0.0040 | 0.043 | 0.97 | 0.50 | 0.0052 | 0.0020 |
| 29 | 0.26 | 0.21 | 0.79 | 0.012 | 0.0040 | 0.043 | 0.97 | 0.50 | 0.0052 | 0.0020 |
| 30 | 0.26 | 0.25 | 0.50 | 0.007 | 0.0030 | 0.035 | 0.95 | 0.50 | 0.0050 | 0.0015 |
| 31 | 0.23 | 0.21 | 0.51 | 0.012 | 0.0040 | 0.040 | 0.95 | 0.50 | 0.0050 | 0.0017 |
| 32 | 0.26 | 0.21 | 0.54 | 0.012 | 0.0040 | 0.043 | 0.97 | 0.48 | 0.0052 | 0.0020 |
| 33 | 0.26 | 0.21 | 0.54 | 0.012 | 0.0040 | 0.043 | 0.97 | 0.48 | 0.0052 | 0.0020 |
| 34 | 0.26 | 0.28 | 0.83 | 0.010 | 0.0038 | 0.028 | 1.21 | 0.30 | 0.0052 | 0.0012 |
| 35 | 0.27 | 0.30 | 0.90 | 0.010 | 0.0020 | 0.030 | 0.50 | 0.30 | 0.0050 | 0.0010 |
| 36 | 0.27 | 0.30 | 0.80 | 0.010 | 0.0020 | 0.030 | 0.50 | 0.50 | 0.0050 | 0.0010 |
| 37 | 0.27 | 0.30 | 0.80 | 0.010 | 0.0020 | 0.030 | 0.50 | 0.50 | 0.0050 | 0.0010 |
| 38 | 0.27 | 0.30 | 0.60 | 0.010 | 0.0020 | 0.030 | 0.50 | 0.70 | 0.0050 | 0.0010 |
| 39 | 0.27 | 0.24 | 0.55 | 0.010 | 0.0030 | 0.041 | 1.01 | 0.50 | 0.0050 | 0.0016 |
| 40 | 0.26 | 0.22 | 0.53 | 0.012 | 0.0040 | 0.040 | 0.97 | 0.48 | 0.0050 | 0.0017 |
| 41 | 0.27 | 0.25 | 0.77 | 0.012 | 0.0040 | 0.043 | 1.12 | 0.40 | 0.0044 | 0.0018 |
| 42 | 0.26 | 0.21 | 0.54 | 0.009 | 0.0025 | 0.033 | 0.97 | 0.48 | 0.0050 | 0.0017 |
| 43 | 0.26 | 0.21 | 0.54 | 0.009 | 0.0025 | 0.033 | 0.97 | 0.48 | 0.0050 | 0.0017 |
| 44 | 0.26 | 0.21 | 0.54 | 0.009 | 0.0025 | 0.033 | 0.97 | 0.48 | 0.0050 | 0.0017 |
| 45 | 0.26 | 0.22 | 0.53 | 0.010 | 0.0040 | 0.031 | 0.97 | 0.52 | 0.0050 | 0.0016 |
| 46 | 0.27 | 0.25 | 0.55 | 0.007 | 0.0030 | 0.036 | 1.00 | 0.52 | 0.0050 | 0.0015 |

| Test | Chemical Composition (unit is mass %; balance is Fe and impurities) | | | | | | | | |
|---|---|---|---|---|---|---|---|---|---|
| No. | Ti | V | Nb | B | Ca | Mg | REM | Ni | Cu |
| 1 | 0.012 | | | | | | | | |
| 2 | 0.002 | | | | | | | | |
| 3 | 0.005 | | | | | 0.0012 | | | |
| 4 | 0.006 | | | | | | 0.0012 | | |
| 5 | 0.007 | | | | | | | | |
| 6 | 0.006 | | | | | | | | |
| 7 | 0.005 | | | | | | | | |
| 8 | 0.007 | | | | | | | 0.02 | 0.02 |
| 9 | 0.008 | | | | 0.0012 | | | 0.03 | 0.02 |
| 10 | 0.008 | | | | 0.0012 | | | 0.03 | 0.02 |
| 11 | 0.008 | | | | 0.0012 | | | 0.03 | 0.02 |
| 12 | 0.009 | | | | 0.0011 | | | 0.03 | 0.02 |
| 13 | 0.008 | | | | 0.0012 | | | 0.03 | 0.02 |
| 14 | 0.009 | | | | 0.0012 | | | 0.04 | 0.03 |
| 15 | 0.009 | | | | 0.0012 | | | 0.04 | 0.03 |
| 16 | 0.009 | | | | 0.0013 | | | | |
| 17 | 0.007 | | 0.001 | | 0.0013 | | | 0.02 | 0.03 |
| 18 | 0.009 | | | | 0.0013 | | | | |
| 19 | 0.009 | 0.02 | | | 0.0012 | | | 0.04 | 0.03 |
| 20 | 0.009 | | | 0.0001 | 0.0011 | | | 0.02 | 0.02 |
| 21 | 0.008 | | | | | | | | |
| 22 | 0.008 | | | | | | | 0.02 | 0.02 |
| 23 | 0.009 | | | | 0.0011 | | | 0.03 | 0.02 |
| 24 | 0.009 | | | | | | | | |
| 25 | 0.009 | | | | | | | | |
| 26 | 0.008 | | | | | | | | |
| 27 | 0.008 | | | | 0.0012 | | | 0.03 | 0.02 |
| 28 | 0.010 | | | | | | | | |
| 29 | 0.010 | | | | 0.0013 | | | 0.03 | 0.02 |
| 30 | | 0.04 | | | 0.0013 | | | 0.02 | 0.03 |
| 31 | 0.001 | | | | 0.0013 | | | | |
| 32 | 0.010 | 0.01 | | | | | | | |
| 33 | 0.010 | 0.01 | | | 0.0013 | | | 0.03 | 0.02 |
| 34 | 0.008 | | | | | | | 0.02 | 0.01 |
| 35 | 0.010 | 0.10 | | | | | | | |
| 36 | 0.010 | 0.06 | | | | | | | |
| 37 | 0.010 | 0.08 | | | | | | | |
| 38 | 0.010 | 0.04 | | | | | | | |
| 39 | 0.016 | | | | 0.0011 | | | 0.02 | 0.02 |
| 40 | 0.010 | | | 0.0005 | 0.0012 | | | 0.03 | 0.01 |
| 41 | 0.010 | | 0.006 | | | | | | |
| 42 | 0.008 | | | | 0.0012 | | | 0.03 | 0.02 |
| 43 | 0.008 | | | | 0.0012 | | | 0.03 | 0.02 |
| 44 | 0.008 | | | | 0.0012 | | | 0.03 | 0.02 |
| 45 | 0.008 | | | | 0.0012 | | | 0.02 | 0.02 |
| 46 | 0.009 | | | | 0.0012 | | | 0.02 | 0.02 |

The aforementioned molten steels were used to produce billets by a continuous casting process. The produced billet of each test number was heated in a rotary hearth-type continuous heating furnace. The in-furnace temperature T1 and the residence time t1 in the preheating zone Z1, the in-furnace temperature T2 and the total residence time t2 in the heating zone Z2 and the soaking zone Z3, the FA value, and the furnace time in the heating furnace (the time period from when the billet was charged into the charging port 11 of the preheating zone Z1 until the billet was discharged from the extraction port 12 of the soaking zone Z3) were as shown in the columns "Temperature T1 (° C.)". "Residence Time t1 (minutes)", "Temperature T2 (° C.)", "Total Residence Time t2 (minutes)", "FA", and "Furnace Time in Heating Furnace (minutes)", respectively, in Table 2. In addition, the working time for each test number was as shown in the column "Working Time (minutes)" in Table 2. Specifically, "≤15" in the "Working Time (minutes)" column indicates that the working time was 15 minutes or less. Further, ">15" indicates that the working time was more than 15 minutes.

TABLE 2

| | Billet Heating Process | | | | | | | Heat Treatment Process | | | | |
|---|---|---|---|---|---|---|---|---|---|---|---|---|
| | Preheating Zone | | Heating Zone + Soaking Zone | | | Furnace | | | Quenching | | Tempering | |
| Test No. | Temperature T1 (° C.) | Residence Time t1 (minutes) | Temperature T2 (° C.) | Total Residence Time t2 (minutes) | FA | Time in Heating Furnace (minutes) | Working Time (minutes) | Quenching Type | Temperature (° C.) | Time (minutes) | Temperature (° C.) | Time (minutes) |
| 1 | 1230 | 130 | 1230 | 130 | 2212 | 260 | ≤15 | In-line | 950 | 10 | 830 | 40 |
| 2 | 1230 | 130 | 1290 | 130 | 2301 | 260 | ≤15 | In-line | 950 | 10 | 615 | 30 |
| 3 | 1220 | 130 | 1270 | 120 | 2182 | 260 | ≤15 | In-line | 950 | 10 | 825 | 40 |
| 4 | 1220 | 130 | 1270 | 120 | 2182 | 260 | ≤15 | In-line | 950 | 10 | 625 | 40 |
| 5 | 1220 | 130 | 1300 | 130 | 2315 | 260 | ≤15 | In-line | 950 | 10 | 625 | 40 |
| 6 | 1230 | 100 | 1270 | 120 | 2182 | 220 | ≤15 | In-line | 950 | 10 | 625 | 40 |
| 7 | 1200 | 130 | 1250 | 80 | 1759 | 210 | ≤15 | In-line | 950 | 10 | 625 | 40 |
| 8 | 1100 | 90 | 1230 | 80 | 1736 | 170 | ≤15 | En-line | 950 | 10 | 610 | 45 |
| 9 | 1200 | 100 | 1250 | 210 | 2849 | 310 | ≤15 | In-line | 950 | 10 | 625 | 30 |
| 10 | 1000 | 110 | 1250 | 150 | 2408 | 260 | ≤15 | In-line | 950 | 10 | 610 | 15 |
| 11 | 1220 | 100 | 1230 | 150 | 2376 | 250 | ≤15 | In-line | 950 | 10 | 625 | 50 |
| 12 | 1050 | 140 | 1230 | 130 | 2212 | 270 | ≤15 | In-line | 950 | 10 | 625 | 40 |
| 13 | 1180 | 100 | 1230 | 150 | 2376 | 250 | ≤15 | In-line | 950 | 10 | 605 | 20 |
| 14 | 1000 | 150 | 1270 | 235 | 3054 | 385 | ≤15 | In-line | 950 | 10 | 625 | 50 |
| 15 | 1240 | 100 | 1270 | 235 | 3054 | 335 | ≤15 | In-line | 950 | 10 | 605 | 20 |
| 16 | 1210 | 120 | 1230 | 110 | 2035 | 230 | ≤15 | In-line | 950 | 10 | 625 | 50 |
| 17 | 1130 | 220 | 1210 | 480 | 4195 | 700 | ≤15 | In-line | 950 | 10 | 605 | 20 |
| 18 | 1100 | 110 | 1230 | 100 | 1940 | 210 | ≤15 | In-fine | 950 | 10 | 605 | 20 |
| 19 | 1220 | 120 | 1300 | 140 | 2403 | 260 | ≤15 | In-line | 950 | 10 | 625 | 50 |
| 20 | 1220 | 100 | 1300 | 150 | 2487 | 250 | ≤15 | In-line | 950 | 10 | 625 | 45 |
| 21 | 1230 | 100 | 1250 | 140 | 2326 | 240 | ≤15 | Off-line | 1030 | 30 | 625 | 20 |
| 22 | 1200 | 100 | 1250 | 100 | 1966 | 200 | ≤15 | Off-line | 1030 | 30 | 625 | 20 |
| 23 | 1100 | 135 | 1220 | 55 | 1429 | 190 | ≤15 | Off-line | 1030 | 30 | 625 | 20 |
| 24 | 1000 | 100 | 1195 | 55 | 1406 | 155 | ≤15 | Off-line | 1030 | 30 | 625 | 20 |
| 25 | 1200 | 100 | 1250 | 120 | 2154 | 220 | >15 | Off-line | 1030 | 30 | 625 | 20 |
| 26 | 1200 | 100 | 1240 | 130 | 2227 | 230 | ≤15 | In-line | 950 | 10 | 625 | 50 |
| 27 | 1000 | 120 | 1240 | 140 | 2311 | 260 | ≤15 | In-line | 950 | 10 | 625 | 50 |
| 28 | 1000 | 100 | 1230 | 100 | 1940 | 200 | ≤15 | In-line | 950 | 10 | 625 | 50 |
| 29 | 1200 | 130 | 1250 | 80 | 1759 | 210 | ≤15 | In-line | 950 | 10 | 625 | 50 |
| 30 | 1000 | 100 | 1220 | 120 | 2111 | 220 | ≤15 | In-line | 950 | 10 | 625 | 50 |
| 31 | 1000 | 160 | 1230 | 130 | 2212 | 290 | ≤15 | In-line | 950 | 10 | 625 | 50 |
| 32 | 1220 | 100 | 1230 | 120 | 2126 | 220 | ≤15 | In-line | 950 | 10 | 625 | 50 |
| 33 | 1200 | 80 | 1220 | 135 | 2240 | 215 | ≤15 | In-line | 950 | 10 | 625 | 50 |
| 34 | 1000 | 140 | 1240 | 130 | 2227 | 270 | ≤15 | In-line | 950 | 10 | 610 | 45 |
| 35 | 1000 | 160 | 1240 | 140 | 2311 | 300 | ≤15 | In-line | 950 | 10 | 630 | 30 |
| 36 | 1180 | 100 | 1230 | 150 | 2376 | 250 | ≤15 | In-line | 950 | 10 | 630 | 30 |
| 37 | 1200 | 90 | 1250 | 150 | 2408 | 240 | ≤15 | In-line | 950 | 10 | 630 | 30 |
| 38 | 1160 | 120 | 1230 | 100 | 1940 | 220 | ≤15 | In-line | 950 | 10 | 630 | 30 |
| 39 | 1160 | 120 | 1230 | 100 | 1940 | 220 | ≤15 | In-line | 950 | 10 | 625 | 50 |
| 40 | 1100 | 110 | 1230 | 100 | 1940 | 210 | ≤15 | In-line | 950 | 10 | 625 | 50 |
| 41 | 1200 | 100 | 1220 | 100 | 1927 | 200 | ≤15 | In-line | 950 | 10 | 630 | 30 |
| 42 | 1210 | 120 | 1230 | 110 | 2035 | 230 | ≤15 | In-line | 950 | 10 | 600 | 15 |
| 43 | 1000 | 100 | 1230 | 100 | 1940 | 200 | ≤15 | In-line | 950 | 10 | 605 | 10 |
| 44 | 1100 | 100 | 1230 | 80 | 1736 | 180 | ≤15 | In-line | 950 | 10 | 625 | 60 |
| 45 | 1200 | 100 | 1250 | 150 | 2408 | 250 | ≤15 | Off-line | 920 | 30 | 630 | 30 |
| 46 | 1200 | 100 | 1250 | 150 | 2408 | 250 | ≤15 | Off-line | 920 | 30 | 635 | 30 |

TABLE 2-continued

| Test No. | Heat Treatment Process Tempering TMP | Poor-γ Grain Size Number | F1 | F2 | F3 | F4 | Coarse Mn Sulfides Number Density (/100 mm$^2$) | YS (MPa) | YS (ksi) | Absorbed Energy (J) | Remarks |
|---|---|---|---|---|---|---|---|---|---|---|---|
| 1 | 17901 | 6.0 | 0.733 | 0.212 | 0.120 | 0.203 | 5 | 910 | 132 | 103 | Inventive Example |
| 2 | 17493 | 5.8 | 0.801 | 0.121 | 0.020 | 0.032 | 6 | 926 | 134 | 124 | Inventive Example |
| 3 | 17802 | 5.1 | 0.798 | 0.160 | 0.050 | 0.088 | 5 | 919 | 133 | 116 | Inventive Example |
| 4 | 17802 | 5.4 | 0.778 | 0.168 | 0.060 | 0.105 | 5 | 946 | 137 | 110 | Inventive Example |
| 5 | 17802 | 4.8 | 0.768 | 0.180 | 0.070 | 0.135 | 6 | 934 | 135 | 113 | Inventive Example |
| 6 | 17802 | 5.1 | 0.798 | 0.172 | 0.060 | 0.105 | 8 | 946 | 137 | 110 | Inventive Example |
| 7 | 17802 | 5.6 | 0.814 | 10.156 | 0.050 | 0.079 | 9 | 959 | 139 | 108 | Inventive Example |
| 8 | 17550 | 5.8 | 0.732 | 0.161 | 0.070 | 0.135 | 7 | 917 | 133 | 135 | Inventive Example |
| 9 | 17690 | 5.6 | 0.731 | 0.197 | 0.080 | 0.167 | 2 | 931 | 135 | 125 | Inventive Example |
| 10 | 17128 | 5.6 | 0.731 | 0.197 | 0.080 | 0.167 | 3 | 993 | 144 | 107 | Inventive Example |
| 11 | 17889 | 5.6 | 0.731 | 0.197 | 0.080 | 0.167 | 3 | 903 | 131 | 133 | Inventive Example |
| 12 | 17802 | 5.9 | 0.719 | 0.203 | 0.090 | 0.184 | 4 | 938 | 136 | 118 | Inventive Example |
| 13 | 17141 | 5.6 | 0.731 | 0.197 | 0.080 | 0.167 | 3 | 993 | 144 | 103 | Inventive Example |
| 14 | 17889 | 6.1 | 0.782 | 0.212 | 0.090 | 0.150 | 5 | 922 | 134 | 126 | Inventive Example |
| 15 | 17141 | 6.0 | 0.787 | 0.213 | 0.090 | 0.150 | 7 | 1014 | 147 | 102 | Inventive Example |
| 16 | 17889 | 5.6 | 0.719 | 0.200 | 0.090 | 0.180 | 4 | 899 | 130 | 134 | Inventive Example |
| 17 | 17141 | 5.8 | 0.711 | 0.191 | 0.080 | 0.200 | 2 | 917 | 133 | 115 | Inventive Example |
| 18 | 17141 | 5.8 | 0.707 | 0.197 | 0.090 | 0.180 | 5 | 989 | 143 | 107 | Inventive Example |
| 19 | 17889 | 6.7 | 0.753 | 0.228 | 0.110 | 0.190 | 7 | 958 | 139 | 110 | Inventive Example |
| 20 | 17848 | 6.3 | 0.706 | 0.220 | 0.090 | 0.176 | 4 | 945 | 137 | 117 | Inventive Example |
| 21 | 17532 | 6.1 | 0.709 | 0.190 | 0.080 | 0.154 | 3 | 972 | 141 | 103 | Inventive Example |
| 22 | 17532 | 6.1 | 0.711 | 0.190 | 0.080 | 0.154 | 3 | 972 | 142 | 102 | Inventive Example |
| 23 | 17532 | 5.9 | 0.723 | 0.203 | 0.090 | 0.173 | 6 | 972 | 142 | 110 | Inventive Example |
| 24 | 17532 | 5.9 | 0.719 | 0.203 | 0.090 | 0.173 | 13 | 972 | 141 | 95 | Inventive Example |
| 25 | 17532 | 5.9 | 0.719 | 0.203 | 0.090 | 0.173 | 13 | 972 | 141 | 95 | Inventive Example |
| 26 | 17889 | 5.8 | 0.673 | 0.194 | 0.080 | 0.178 | 7 | 875 | 127 | 132 | Comparative Example |
| 27 | 17889 | 5.8 | 0.676 | 0.194 | 0.080 | 0.178 | 3 | 883 | 128 | 129 | Comparative Example |
| 28 | 17889 | 5.9 | 0.769 | 0.263 | 0.100 | 0.200 | 9 | 999 | 145 | 94 | Comparative Example |
| 29 | 17889 | 5.8 | 0.779 | 0.265 | 0.100 | 0.200 | 7 | 1001 | 145 | 93 | Comparative Example |
| 30 | 17889 | 5.5 | 0.737 | 0.155 | 0.040 | 0.096 | 5 | 814 | 118 | 105 | Comparative Example |
| 31 | 17889 | 5.4 | 0.699 | 0.115 | 0.010 | 0.020 | 7 | 883 | 128 | 135 | Comparative Example |
| 32 | 17889 | 6.5 | 0.682 | 0.217 | 0.110 | 0.233 | 8 | 1051 | 152 | 88 | Comparative Example |
| 33 | 17889 | 6.3 | 0.696 | 0.220 | 0.110 | 0.233 | 5 | 1053 | 153 | 82 | Comparative Example |
| 34 | 17550 | 5.7 | 0.801 | 0.253 | 0.080 | 0.267 | 18 | 917 | 133 | 77 | Comparative Example |
| 35 | 17788 | 6.6 | 0.647 | 0.394 | 0.200 | 0.733 | 16 | 1027 | 149 | 42 | Comparative Example |
| 36 | 17788 | 6.5 | 0.664 | 0.328 | 0.160 | 0.344 | 17 | 1020 | 148 | 65 | Comparative Example |
| 37 | 17788 | 6.3 | 0.677 | 0.358 | 0.180 | 0.392 | 17 | 1048 | 152 | 40 | Comparative Example |
| 38 | 17788 | 6.1 | 0.679 | 0.274 | 0.140 | 0.211 | 8 | 1089 | 158 | 60 | Comparative Example |
| 39 | 17889 | 6.1 | 0.728 | 0.277 | 0.160 | 0.320 | 5 | 896 | 130 | 85 | Comparative Example |
| 40 | 17889 | 5.9 | 0.717 | 0.320 | 0.100 | 0.208 | 7 | 938 | 136 | 72 | Comparative Example |
| 41 | 17788 | 6.0 | 0.780 | 0.354 | 0.160 | 0.700 | 9 | 917 | 133 | 80 | Comparative Example |
| 42 | 16934 | 5.7 | 0.725 | 0.195 | 0.080 | 0.167 | 3 | 1007 | 146 | 92 | Comparative Example |
| 43 | 16877 | 5.6 | 0.731 | 0.197 | 0.080 | 0.167 | 4 | 1014 | 147 | 90 | Comparative Example |
| 44 | 17960 | 5.8 | 0.720 | 0.194 | 0.080 | 0.167 | 4 | 883 | 128 | 148 | Comparative Example |
| 45 | 17788 | 8.5 | 0.611 | 0.162 | 0.080 | 0.154 | 6 | 841 | 122 | 148 | Comparative Example |
| 46 | 17887 | 8.7 | 0.623 | 0.172 | 0.090 | 0.173 | 5 | 834 | 121 | 149 | Comparative Example |

Each billet after heating was subjected to hot rolling by the Mannesmann-mandrel process (hot working) to produce a hollow shell (seamless steel pipe) of each test number.

The produced hollow shell of each test number was subjected to in-line quenching or off-line quenching. In the case of in-line quenching (described as "In-line" in the column "Quenching Type" in Table 2), the hollow shell after hot working was not cooled to normal temperature, and instead the hollow shell after hot working that was at a temperature of 400° C. or more was charged into a supplementary heating furnace. The hollow shell was held for a holding time (minutes) shown in the column "Time (minutes)" at a quenching temperature (° C.) shown in the column "Temperature (° C.)" of the "Quenching" column in Table 2, and thereafter was water-cooled. On the other hand, in the case of off-line quenching (described as "Off-line" in the column "Quenching Type" in Table 2), the hollow shell after hot working was cooled to normal temperature. After cooling, the hollow shell was charged into a heat treatment furnace. The hollow shell was held for a holding time (minutes) shown in the column "Time (minutes)" at a quenching temperature (° C.) shown in the column "Temperature (° C.)" of the "Quenching" column in Table 2, and thereafter was water-cooled.

After quenching, the hollow shell of each test number was subjected to tempering. Specifically, the hollow shell of each test number was subjected to tempering in which the hollow shell was held for a tempering time (minutes) shown in the column "Time (minutes)" at a tempering temperature (° C.) shown in the column "Temperature (° C.)" of the "Tempering" column in Table 2. Note that the tempering parameter TMP (=(tempering temperature (C)+273)×(20+log (tempering time (minutes)/60))) is shown in the column "TMP" in Table 2.

Note that, in the present example, the temperature of the supplementary heating furnace or heat treatment furnace used for heating in the quenching was taken as the quenching temperature (° C.). Further, the temperature of the heat treatment furnace used for tempering was taken as the tempering temperature (° C.).

Seamless steel pipes that were steel materials were produced by the above production process.

[Evaluation Tests]

The steel material (seamless steel pipe) of each test number was subjected to the following evaluation tests.

[Microstructure Observation Test]

The microstructure of the steel material (seamless steel pipe) of each test number was observed by the following method, and the total area fraction (%) of martensite and bainite was determined. A test specimen having an observation surface including the pipe axis direction and wall thickness (pipe diameter) direction was taken from a center portion of the wall thickness of the steel material. After polishing the observation surface of the test specimen to a mirror finish, the test specimen was immersed for 10 seconds in a nital etching reagent to reveal the microstructure by etching. Using an SEM, 10 visual fields of the etched observation surface were observed in a secondary electron image. The area of the visual field was set to 0.01 $mm^2$ (magnification of 1000×). In each visual field, martensite and bainite were identified based on contrast, and the total area fraction (%) of the identified martensite and bainite was determined. The arithmetic mean value of the total area fraction (%) of martensite and bainite determined in the 10 visual fields was defined as the total area fraction (%) of martensite and bainite. The result of the measurement showed that in each test number the total area fraction of martensite and bainite was 90% or more.

[Test to Determine Grain Size Number of Prior-Austenite Grains]

The grain size number of prior-austenite grains of the steel material (seamless steel pipe) of each test number was determined by the following method. A test specimen was taken from a center portion of the wall thickness of the steel material (seamless steel pipe) in a manner so that a cross section perpendicular to the longitudinal direction (rolling direction) of the steel material became the surface to be examined. The taken test specimen was embedded in resin, and the surface to be examined was mirror polished. After the surface to be examined was mirror polished, prior-austenite grain boundaries were revealed by the Bechet-Beaujard method in which the surface to be examined was etched with an aqueous solution saturated with picric acid. The grain size number of the prior-austenite grains was measured in conformity with ASTM E112-13. The obtained grain size number is shown in the column "Prior-γ Grain Size Number" in Table 2. Note that, the F1 to F4 values of each test number are shown in the columns "F1" to "F4" immediate right of the column "Prior-γ Grain Size Number" in Table 2.

[Test to Measure Number Density of Mn Sulfides]

The number density (/100 $mm^2$) of Mn sulfides in the steel material of each test number was determined by the following method. A test specimen was taken from a center portion of the wall thickness of the steel material (seamless steel pipe). The taken test specimen was embedded in resin in a manner so that a face of the test specimen which included the pipe axis direction and wall thickness (pipe diameter) direction became the observation surface. The observation surface of the test specimen embedded in resin was polished. An arbitrary 10 visual fields on the observation surface after polishing were observed. The area of each visual field was set to 100 $mm^2$. Mn sulfides in each visual field were identified by the method described above. The total number of Mn sulfides having an equivalent circular diameter of 5.0 μm or more (coarse Mn sulfides) among the Mn sulfides identified in the 10 visual fields was determined. The number density of coarse Mn sulfides (/100 $mm^2$) was determined based on the determined total number of coarse Mn sulfides and the total area of the 10 visual fields. The obtained number density of coarse Mn sulfides is shown in the column "Coarse Mn Sulfides Number Density (/100 $mm^2$)" in Table 2.

[Yield Strength Measurement Test]

The yield strength of the steel material of each test number was determined by the following method. A tensile test was performed by a method conforming to ASTM E8/E8M (2013). A round bar specimen was taken from a center portion of the wall thickness of the steel material (seamless steel pipe) of each test number. The size of the round bar specimen was as follows: the parallel portion diameter was 6.35 mm, and the parallel portion length was 25.4 mm. The axial direction of the round bar specimen was parallel with the longitudinal direction (rolling direction) of the steel material (seamless steel pipe). A tensile test was carried out in the atmosphere at normal temperature (25° C.) using the round bar specimen, and the obtained stress at a time of 0.65% total elongation was defined as the yield strength (MPa). The obtained yield strength (MPa) is shown in the column "YS (MPa)" in Table 2, and the yield strength (ksi) is shown in the column "YS (ksi)" in Table 2.

[Low-Temperature Toughness Evaluation Test]

The absorbed energy at −10° C. of the steel material of each test number was determined by the following method. The steel material of each test number was subjected to a Charpy impact test conforming to ASTM E23 (2018). Specifically, in conformity with API specification 5CT (10th edition), full-size V-notch test specimens were taken from a center portion of the wall thickness of the steel material (seamless steel pipe) of each test number. The longitudinal direction of each V-notch test specimen was made perpendicular to the longitudinal direction (rolling direction) of the steel material (seamless steel pipe). The V-notch test specimens were prepared in conformity with ASTM E23 (2018). The Charpy impact test was conducted at −10° C. in accordance with ASTM E23 (2018) using three of the V-notch test specimens as one set to measure the absorbed energy. The arithmetic mean value of the absorbed energy of the three test specimens was defined as the absorbed energy (J) at −10° C. The obtained absorbed energy is shown in the column "Absorbed Energy (J)" in Table 2.

[Evaluation Results]

Referring to Table 1 and Table 2, the content of each element in the chemical compositions of Test Nos. 1 to 25 was appropriate. Further, the grain size number of prior-austenite grains was less than 7.0. In addition, F1 to F4 satisfied Formula (1) to Formula (4). As a result, sufficiently high strength and excellent low-temperature toughness were obtained. Specifically, the yield strength was 896 MPa (130 ksi) or more, and the absorbed energy at −10° C. was 95 J or more.

In addition, in Test Nos. 1 to 23, in the heating process, FA in the heating zone Z2 and the soaking zone Z3 was 1420 or more, and furthermore the working time was 15 minutes or less. On the other hand, in Test No. 24, FA was less than 1420. In Test No. 25, the working time was more than 15 minutes. Therefore, in Test Nos. 1 to 23, the number density of Mn sulfides was 10/100 $mm^2$ or less, and the number density of Mn sulfides was less than the number density in Test Nos. 24 and 25. Consequently, the absorbed energy at −10° C. in Test Nos. 1 to 23 was 100 J or more, which was even higher than the absorbed energy in Test Nos. 24 and 25.

On the other hand, in Test Nos. 26 and 27, F1 did not satisfy Formula (1). Therefore, the strength was low. Specifically, the yield strength was less than 896 MPa (130 ksi).

In Test Nos. 28 and 29, F2 did not satisfy Formula (2). Therefore, the low-temperature toughness was low. Specifically, the absorbed energy at −10° C. was less than 95 J.

In Test No. 30, the chemical composition did not contain Ti. Therefore, the strength was low. Specifically, the yield strength was less than 896 MPa (130 ksi).

In Test No. 31, F3 did not satisfy Formula (3). Therefore, the strength was low. Specifically, the yield strength was less than 896 MPa (130 ksi).

In Test Nos. 32 and 33, F4 did not satisfy Formula (4). Therefore, the low-temperature toughness was low. Specifically, the absorbed energy at −10° C. was less than 95 J.

In Test No. 34, the Mn content was too high. Therefore, the low-temperature toughness was low. Specifically, the absorbed energy at −10° C. was less than 95 J.

In Test Nos. 35 to 37, the Mn content was too high. In addition, the V content was too high. Therefore, the low-temperature toughness was low. Specifically, the absorbed energy at −10° C. was less than 95 J.

In Test Nos. 38 and 41, F2 did not satisfy Formula (2), and F4 did not satisfy Formula (4). Therefore, the low-temperature toughness was low. Specifically, the absorbed energy at −10° C. was less than 95 J.

In Test No. 39, the Ti content was too high. Therefore, the low-temperature toughness was low. Specifically, the absorbed energy at −10° C. was less than 95 J.

In Test No. 40, the B content was too high. Therefore, the low-temperature toughness was low. Specifically, the absorbed energy at −10° C. was less than 95 J.

In Test Nos. 42 and 43, the tempering parameter TMP was too low. Therefore, the low-temperature toughness was low. Specifically, the absorbed energy at −10° C. was less than 95 J.

In Test No. 44, the tempering parameter TMP was too high. Therefore, the strength was low. Specifically, the yield strength was less than 896 MPa (130 ksi).

In Test Nos. 45 and 46, although quenching was performed off-line, the quenching temperature was less than 930° C. Therefore, the grain size number of prior-austenite grains was 7.0 or more, and F1 did not satisfy Formula (1). Consequently, the strength was low. Specifically, the yield strength was less than 896 MPa (130 ksi).

An embodiment of the present invention has been described above. However, the embodiment described above is merely an example for carrying out the present invention. Therefore, the present invention is not limited to the above-described embodiment, and can be practiced by appropriately modifying the above-described embodiment within a range not departing from the spirit thereof.

The invention claimed is:

1. A steel material consisting of, in mass %,
C: 0.15 to 0.45%,
Si: 0.05 to 1.00%,
Mn: 0.05 to less than 0.80%,
P: 0.030% or less,
S: 0.0100% or less,
Al: 0.100% or less,
Cr: 0.30 to 1.50%,
Mo: 0.25 to 2.00%,
Ti: 0.001 to 0.015%,
N: 0.0100% or less,
O: 0.0050% or less,
V: 0 to 0.05%,
Nb: 0 to 0.010%,
B: 0 to less than 0.0005%,
Ca: 0 to 0.0100%,
Mg: 0 to 0.0100%,
rare earth metal: 0 to 0.0100%,
Ni: 0 to 0.50%, and
Cu: 0 to 0.50%,
with the balance being Fe and impurities,
wherein:
a grain size number of prior-austenite grains is less than 7.0;
on a precondition that a content of each element is within a range described above, Formula (1) to Formula (4) are satisfied;
a yield strength is 896 MPa or more; and
an absorbed energy at −10° C. is 95 J or more:

$$\{C+Mn/5+(Cu+Ni)/15+(Cr+Mo+V)/5+10\times B\}\times(7.0/GN)^{0.45}\geq 0.678 \quad (1)$$

$$\{Mn/5.5+10\times Ti+1.2\times V+15\times Nb+200\times B\}\times(7.0/GN)^{0.45}\leq 0.240 \quad (2)$$

$$10\times Ti+V+10\times Nb\geq 0.015 \quad (3)$$

$$(10\times Ti+1.2\times V+30\times Nb)/Mo\leq 0.205 \quad (4)$$

where, a content in mass % of a corresponding element is substituted for each symbol of an element, and the grain size number is substituted for "GN".

2. The steel material according to claim 1, wherein:
a number density of Mn sulfides having an equivalent circular diameter of 5.0 μm or more is 10/100 $mm^2$ or less; and
an absorbed energy at −10° C. is 100 J or more.

3. The steel material according to claim 1, containing one or more types of element selected from the group consisting of:
V: 0.01 to 0.05%,
Nb: 0.001 to 0.010%,
B: 0.0001 to less than 0.0005%,
Ca: 0.0001 to 0.0100%,
Mg: 0.0001 to 0.0100%,
rare earth metal: 0.0001 to 0.0100%,
Ni: 0.01 to 0.50%, and
Cu: 0.01 to 0.50%.

4. The steel material according to claim 2, containing one or more types of element selected from the group consisting of:
V: 0.01 to 0.05%,
Nb: 0.001 to 0.010%,
B: 0.0001 to less than 0.0005%,
Ca: 0.0001 to 0.0100%,
Mg: 0.0001 to 0.0100%,
rare earth metal: 0.0001 to 0.0100%,
Ni: 0.01 to 0.50%, and
Cu: 0.01 to 0.50%.

5. The steel material according to claim 1, wherein:
the steel material is an oil-well steel pipe.

6. The steel material according to claim 2, wherein:
the steel material is an oil-well steel pipe.

7. The steel material according to claim 3, wherein:
the steel material is an oil-well steel pipe.

8. The steel material according to claim 4, wherein:
the steel material is an oil-well steel pipe.

* * * * *